US005395547A

United States Patent [19]

Broadwell et al.

[11] Patent Number: 5,395,547

[45] Date of Patent: Mar. 7, 1995

[54] PROCESS OF MAKING AN AQUEOUS VISCOELASTIC AUTOMATIC DISHWASH DETERGENT CONTAINING A SILICATE-NEUTRALIZED CROSSLINKED POLYACRYLATE

[75] Inventors: Roger Broadwell, Green Pond; Makarand Shevade, Plainsboro, both of N.J.

[73] Assignee: Colgate Palmolive Co., Piscataway, N.J.

[21] Appl. No.: 88,596

[22] Filed: Jul. 8, 1993

Related U.S. Application Data

[63] Continuation-in-part of Ser. No. 824,275, Jan. 23, 1992, Pat. No. 5,246,615, which is a continuation-in-part of Ser. No. 686,892, Apr. 19, 1991, abandoned, which is a continuation-in-part of Ser. No. 353,712, May 18, 1989, Pat. No. 5,064,553.

[51] Int. Cl.[6] ..... C11D 3/37; C11D 7/14; C11D 7/16; C11D 11/04

[52] U.S. Cl. ..... 252/97; 252/99; 252/103; 252/173; 252/174.11; 252/174.24; 252/DIG. 14

[58] Field of Search ..... 252/97, 99, 103, 173, 252/174.11, 174.24, DIG. 14

[56] References Cited

U.S. PATENT DOCUMENTS

| | | | |
|---|---|---|---|
| 4,226,736 | 10/1980 | Bush | 252/135 |
| 4,836,946 | 6/1989 | Dixit | 252/97 |
| 4,857,226 | 8/1989 | Drapier | 252/174.25 |
| 4,859,358 | 8/1989 | Gabriel | 252/99 |
| 4,867,896 | 9/1989 | Elliott | 252/94 |
| 4,941,988 | 7/1990 | Wise | 252/99 |
| 4,968,445 | 11/1990 | Ahmed | 252/99 |
| 4,968,446 | 11/1990 | Ahmed | 252/99 |
| 4,970,016 | 11/1990 | Ahmed | 252/99 |
| 4,988,452 | 1/1991 | Kinstedt | 252/99 |
| 5,064,553 | 11/1991 | Dixit | 252/94 |
| 5,089,162 | 2/1992 | Rapisarda | 252/102 |
| 5,130,043 | 7/1992 | Prince | 252/95 |
| 5,141,664 | 8/1992 | Corring | 252/90 |
| 5,246,615 | 9/1993 | Broadwell | 252/135 |

*Primary Examiner*—Dennis Albrecht
*Attorney, Agent, or Firm*—Richard E. Nanfeldt; Robert C. Sullivan; Murray Grill

[57] ABSTRACT

An aqueous solution of an alkali metal neutralized polyacrylic acid and an alkali metal detergent builder salt and/or an alkali metal silicate is used as a base stock polymeric solution for the fomulation of an automatic dishwasher detergent composition which is a linear viscoelastic, pseudoplastic, gel-like aqueous product of exceptionally good physical stability, low bottle residue, low cup leakage, and improved cleaning performance. Linear viscoelasticity and pseudoplastic behavior is attributed by incorporation of cross-linked high molecular weight polyacrylic acid type thickener. Potassium to sodium weight ratios of at least 1/1 minimize amount of undissolved solid particles to further contribute to stability and pourability. Control of incorporated air bubbles functions to provide the product with a bulk density of about 1.35 to 1.40 g/cc which roughly corresponds to the density of the liquid phase. Stearic acid or other fatty acid or salt further improved physical stability.

3 Claims, 15 Drawing Sheets

PROCESS OF MAKING AN AQUEOUS VISCOELASTIC AUTOMATIC DISHWASH DETERGENT CONTAINING A SILICATE-NEUTRALIZED CROSSLINKED POLYACRYLATE

CROSS-REFERENCE TO RELATED APPLICATION

This application is a continuation-in-part of U.S. Ser. No. 07/824,275, filed Jan. 23, 1992, now U.S. Pat. No. 5,246,615, which in turn is a continuation-in-part of U.S. Ser. No. 7/686,892, filed Apr. 19, 1991, now abandoned, which in turn is a continuation-in-part of prior application, Ser. No. 353,712, filed May 18, 1989, now U.S. Pat. No. 5,064,553. The disclosure of the prior applications are incorporated herein in its entirety by reference thereto.

FIELD OF INVENTION

The present invention relates generally to a polymeric solution used in preparing an automatic dishwasher detergent composition in the form of an aqueous linear viscoelastic liquid.

BACKGROUND OF THE INVENTION

The acceptance and popularity of the liquid formulations as compared to the more conventional powder products stems from the convenience and performance of the liquid products. However, even the best of the currently available liquid formulations still suffer from two major problems, product phase instability and bottle residue, and to some extent cup leakage from the dispenser cup of the automatic dishwashing machine.

Representative of the relevant patent art in this area, mention is made of Rek, U.S. Pat. No. 4,556,504; Bush, et al., U.S. Pat. No. 4,226,736; Ulrich, U.S. Pat. No. 4,431,559; Sabatelli, U.S. Pat. No. 4,147,650; Paucot, U.S. Pat. No. 4,079,015; Leikhem, U.S. Pat. No. 4,116,849; Milora, U.S. Pat. No. 4,521,332; Jones, U.S. Pat. No. 4,597,889; Heile, U.S. Pat. No. 4,512,908; Laitem, U.S. Pat. No. 4,753,748; Sabatelli, U.S. Pat. No. 3,579,455; Hynam, U.S. Pat. No. 3,684,722. Other patents relating to thickened detergent compositions include U.S. Pat. No. 3,985,668; U.K. Patent Applications GB 2,116,199A and GB 240,450A; U.S. Pat. No. 4,511,487; U.S. Pat. No. 4,752,409 (Drapier, et al.); U.S. Pat. No. 4,801,395 (Drapier, et al.). Commonly assigned patents include U.S. Pat. Nos. 4,836,946; 4,857,226; 4,968,445; 4,968,446 and 4,970,016. Commonly assigned applications include Ser. No. 204,476 filed Jun. 8, 1988, now abandoned and Ser. No. 328,716 filed Mar. 27, 1989, now abandoned.

The present invention provides a solution to the above problems.

SUMMARY OF THE INVENTION

Figure 1:
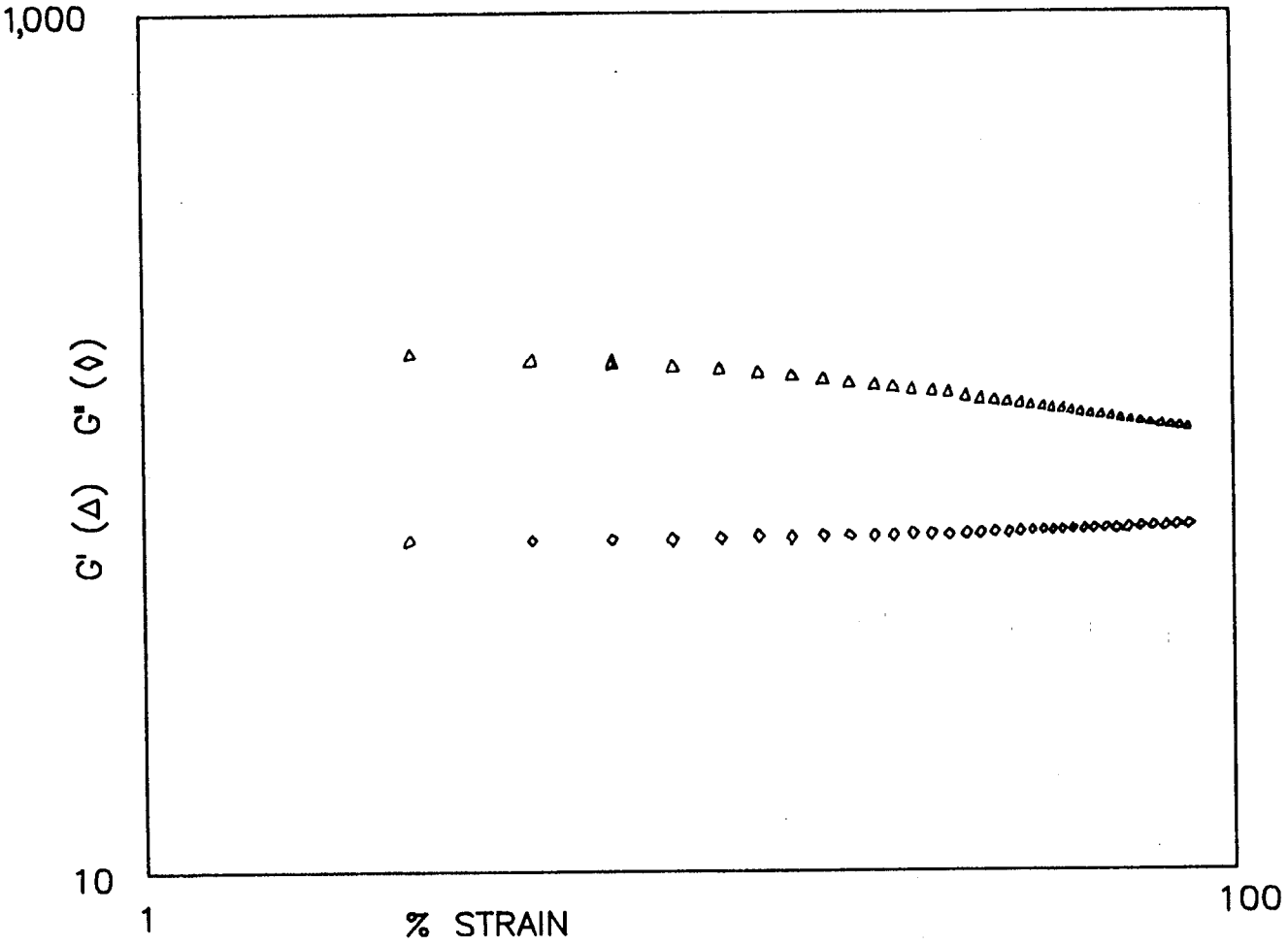
FIGS. 1–13 are rheograms, plotting elastic modules G′ and viscous modulus G″ as a function of applied strain, for the compositions of Example 1, Formulations A, C, D. G. J. H, I and K, Example 2, A and B, Example 3, L and M and Comparative Example 1, respectively.

According to the present invention there is provided a process for preparing a novel aqueous liquid automatic dishwasher detergent composition. The composition is characterized by its linear viscoelastic behavior, substantially indefinite stability against phase separation or settling of dissolved or suspended particles, low levels of bottle residue, relatively high bulk density, and substantial absence of unbound or free water. This unique combination of properties is achieved by virtue of the incorporation into the aqueous mixture of dishwashing detergent surfactant, alkali metal detergent builder salt(s) and chlorine bleach compound, a small but effective amount of high molecular weight cross-linked polyacrylic acid type thickening agent, a physical stabilizing amount of a long chain fatty acid or salt thereof, and a source of potassium ions to provide a potassium/sodium weight ratio in the range of from about 1:1 to about 45:1, such that substantially all of the detergent builder salts and other normally solid detergent additives present in the composition are present dissolved in the aqueous phase. The compositions are further characterized by a bulk density of at least about 1.32 g/cc, such that the density of the polymeric phase and the density of the aqueous (continuous) phase are approximately the same.

DETAILED DESCRIPTION AND PREFERRED EMBODIMENTS

A process for preparing the compositions of this invention which are aqueous liquids containing various cleansing active ingredients, detergent adjuvants, structuring and thickening agents and stabilizing components, although some ingredients may serve more than one of these functions is disclosed.

The advantageous characteristics of the compositions of this invention, including physical stability, low bottle residue, high cleaning performance, e.g. low spotting and filming, dirt residue removal, and so on, and superior aesthetics, are believed to be attributed to several interrelated factors such as low solids, i.e. undissolved particulate content, product density and linear viscoelastic rheology. These factors are, in turn, dependent on several critical compositional components of the formulations, namely, (1) the inclusion of a thickening effective amount of polymeric thickening agent having high water absorption capacity, exemplified by high molecular weight cross-linked polyacrylic acid, (2) inclusion of a physical stabilizing amount of a long chain fatty acid or salt thereof, (3) potassium ion to sodium ion weight ratio K/Na in the range of from about 1:1 to 45:1, especially from 1:1 to 3:1, and (4) a product bulk density of at least about 1.32 g/cc, such that the bulk density and liquid phase density are about the same.

The polymeric thickening agents contribute to the linear viscoelastic rheology of the invention compositions. As used herein, "linear viscoelastic" or "linear viscoelasticity" means that the elastic (storage) moduli (G′) and the viscous (loss) moduli (G″) are both substantially independent of strain, at least in an applied strain range of from 0–50%, and preferably over an applied strain range of from 0 to 80%. More specifically, a composition is considered to be linear viscoelastic for purposes of this invention, if over the strain range of 0–50% the elastic moduli G′ has a minimum value of 100 dynes/sq.cm., preferably at least 250 dynes/sq.cm., and varies less than about 500 dynes/sq.cm., preferably less than 300 dynes/sq.cm., especially preferably less than 100 dynes/sq.cm. Preferably, the minimum value of G' and maximum variation of G' applies over the strain range of 0 to 80%. Typically, the variation in loss moduli G'' will be less than that of G'. As a further characteristic of the preferred linear viscoelastic compositions the ratio of G''/G' (tan δ) is less than 1, preferably less than 0.8, but more than 0.05, preferably more than 0.2, at least over the strain range of 0 to 50%, and preferably over the strain range of 0 to 80%. It should be noted in this regard that % strain is shear strain x100.

By way of further explanation, the elastic (storage) modulus G' is a measure of the energy stored and retrieved when a strain is applied to the composition while viscous (loss) modulus G'' is a measure of the amount of energy dissipated as heat when strain is applied. Therefore, a value of tan δ, $$0.05 < \tan \delta < 1$$

preferably $$0.2 < \tan \delta < 0.8$$

means that the compositions will retain sufficient energy when a stress or strain is applied, at least over the extent expected to be encountered for products of this type, for example, when poured from or shaken in the bottle, or stored in the dishwasher detergent dispenser cup of an automatic dishwashing machine, to return to its previous condition when the stress or strain is removed. The compositions with tan values in these ranges, therefore, will also have a high cohesive property, namely, when a shear or strain is applied to a portion of the composition to cause it to flow, the surrounding portions will follow. As a result of this cohesiveness of the subject linear viscoelastic compositions, the compositions will readily flow uniformly and homogeneously from a bottle when the bottle is tilted, thereby contributing to the physical (phase) stability of the formulation and the low bottle residue (low product loss in the bottle) which characterizes the invention compositions. The linear viscoelastic property also contributes to improved physical stability against phase separation of any undissolved suspended particles by providing a resistance to movement of the particles due to the strain exerted by a particle on the surrounding fluid medium.

Also contributing to the physical stability and low bottle residue of the invention compositions is the high potassium to sodium ion ratios in the range of 1:1 to 45:1, preferably 1:1 to 4:1, especially preferably from 1.05:1 to 3:1, for example 1.1:1, 1.2:1, 1.5:1, 2:1, or 2.5:1. At these ratios the solubility of the solid salt components, such as detergent builder salts, bleach, alkali metal silicates, and the like, is substantially increased since the presence of the potassium ($K^+$) ions requires less water of hydration than the sodium ($Na^+$) ions, such that more water is available to dissolve these salt compounds. Therefore, all or nearly all of the normally solid components are present dissolved in the aqueous phase. Since there is none or only a very low percentage, i.e. less than 5%, preferably less than 3% by weight, of suspended solids present in the formulation there is no or only reduced tendency for undissolved particles to settle out of the compositions causing, for example, formation of hard masses of particles, which could result in high bottle residues (i.e. loss of product). Furthermore, any undissolved solids tend to be present in extremely small particle sizes, usually colloidal or sub-colloidal, such as 1 micron or less, thereby further reducing the tendency for the undissolved particles to settle.

A still further attribute of the invention compositions contributing to the overall product stability and low bottle residue is the high water absorption capacity of the cross-linked polyacrylic acid-type thickening agent. As a result of this high water absorption capacity virtually all of the aqueous vehicle component is held tightly bound to the polymer matrix. Therefore, there is no or substantially no free water present in the invention compositions. This absence of free water (as well as the cohesiveness of the composition) is manifested by the observation that when the composition is poured from a bottle onto a piece of water absorbent filter paper virtually no water is absorbed onto the filter paper and, furthermore, the mass of the linear viscoelastic material poured onto the filter paper will retain its shape and structure until it is again subjected to a stress or strain. As a result of the absence of unbound or free water, there is virtually no phase separation between the aqueous phase and the polymeric matrix or dissolved solid particles. This characteristic is manifested by the fact that when the subject compositions are subjected to centrifugation, e.g. at 1000 rpm for 30 minutes, there is no phase separation and the composition remains homogeneous.

However, it has also been discovered that linear viscoelasticity and K/Na ratios in the above-mentioned range do not, by themselves, assure long term physical stability (as determined by phase separation). In order to maximize physical (phase) stability, the density of the composition should be controlled such that the bulk density of the liquid phase is approximately the same as the bulk density of the entire composition, including the polymeric thickening agent. This control and equalization of the densities is achieved, according to the invention, by providing the composition with a bulk density of at least 1.32 g/cc, preferably at least 1.35 g/cc, up to about 1.42 g/cc, preferably up to about 1.40 g/cc. Furthermore, to achieve these relatively high bulk densities, it is important to minimize the amount of air incorporated into the composition (a density of about 1.42 g/cc is essentially equivalent to zero air content).

It has previously been found in connection with other types of thickened aqueous liquid, automatic dishwasher detergent compositions that incorporation of finely divided air bubbles in amounts up to about 8 to 10% by volume can function effectively to stabilize the composition against phase separation, but that to prevent agglomeration of or escape of the air bubbles it was important to incorporate certain surface active ingredients, especially higher fatty acids and the salts thereof, such as stearic acid, behenic acid, palmitic acid, sodium stearate, aluminum stearate, and the like. These surface active agents apparently functioned by forming an interfacial film at the bubble surface while also forming hydrogen bonds or contributing to the electrostatic attraction with the suspended particles, such that the air bubbles and attracted particles formed agglomerates of approximately the same density as the density of the continuous liquid phase.

Therefore, in a preferred embodiment of the present invention, stabilization of air bubbles which may become incorporated into the compositions during normal processing, such as during various mixing steps, is avoided by post-adding the surface active ingredients, including fatty acid or fatty acid salt stabilizer, to the remainder of the composition, under low shear conditions using mixing devices designed to minimize cavitation and vortex formation.

As will be described in greater detail below the surface active ingredients present in the composition will include the main detergent surface active cleaning agent, and will also preferably include anti-foaming agent and higher fatty acid or salt thereof as a physical stabilizer.

Exemplary of the cross-linked anionic polymers of the instant invention are the cross-linked polyacrylic acid-type thickening agents are the products sold by B.F. Goodrich under their Carbopol trademark, especially Carbopol 941, which is the most ion-insensitive of this class of polymers, and Carbopol 940 and Carbopol 934. The Carbopol resins, also known as "Carbomer," are hydrophilic high molecular weight, cross-linked acrylic acid polymers having an average equivalent weight of 76, and the general structure illustrated by the following formula:

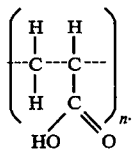

Carbopol 941 has a molecular weight of about 1,250,000; Carbopol 940 a molecular weight of approximately 4,000,000 and Carbopol 934 a molecular weight of approximately 3,000,000. The Carbopol resins are cross-linked with polyalkenyl polyether, e.g. about 1% of a polyallyl ether of sucrose having an average of about 5.8 allyl groups for each molecule of sucrose. Further detailed information on the Carbopol resins is available from B.F. Goodrich, see, for example, the B.F. Goodrich catalog GC-67, Carbopol ® Water Soluble Resins.

While the most favorable results have been achieved with Carbopol 941 polyacrylic resin, other lightly cross-linked polyacrylic acid-type thickening agents can also be used in the compositions of this invention. As used herein "polyacrylic acid-type" refers to water-soluble homopolymers of acrylic acid or methacrylic acid or water-dispersible or water-soluble salts, esters or amides thereof, or water-soluble copolymers of these acids of their salts, esters or amides with each other or with one or more other ethylenically unsaturated monomers, such as, for example, styrene, maleic acid, maleic anhydride, 2-hydroxyethylacrylate, acrylonitrile, vinyl acetate, ethylene, propylene, and the like.

These homopolymers or copolymers are characterized by their high molecular weight, in the range of from about 500,000 to 10,000,000, preferably 500,000 to 5,000,000, especially from about 1,000,000 to 4,000,000, and by their water solubility, generally at least to an extent of up to about 5% by weight, or more, in water at 25° C.

These thickening agents are used in their lightly cross-linked form wherein the cross-linking may be accomplished by means known in the polymer arts, as by irradiation, or, preferably, by the incorporation into the monomer mixture to be polymerized of known chemical cross-linking monomeric agents, typically polyunsaturated (e.g. diethylenically unsaturated) monomers, such as, for example, dininylbenzene, divinylether of diethylene glycol, N,N'-methylenebisacrylamide, polyalkenylpolyethers (such as described above), and the like. Typically, amounts of cross-linking agent to be incorporated in the final polymer may range from about 0.01 to about 1.5 percent, preferably from about 0.05 to about 1.2 percent, and especially, preferably from about 0.1 to about 0.9 percent, by weight of cross-linking agent to weight of total polymer. Generally, those skilled in the art will recognize that the degree of cross-linking should be sufficient to impart some coiling of the otherwise generally linear polymeric compound while maintaining the cross-linked polymer at least water dispersible and highly water-swellable in an ionic aqueous medium. It is also understood that the water-swelling of the polymer which provides the desired thickening and viscous properties generally depends on one or two mechanisms, namely, conversion of the acid group containing polymers to the corresponding salts, e.g. sodium, generating negative charges along the polymer backbone, thereby causing the coiled molecules to expand and thicken the aqueous solution; or by formation of hydrogen bonds, for example, between the carboxyl groups of the polymer and hydroxyl donor. The former mechanism is especially important in the present invention, and therefore, the preferred polyacrylic acid-type thickening agents will contain free carboxylic acid (COOH) groups along the polymer backbone. Also, it will be understood that the degree of cross-linking should not be so high as to render the cross-linked polymer completely insoluble or non-dispersible in water or inhibit or prevent the uncoiling of the polymer molecules in the presence of the ionic aqueous system.

The amount of the high molecular weight, cross-linked polyacrylic acid or other high molecular weight, hydrophilic cross-linked polyacrylic acid-type thickening agent to impart the desired rheological property of linear viscoelasticity will generally be in the range of from about 0.1 to 2%, preferably from about 0.2 to 1.4%, by weight, based on the weight of the composition, although the amount will depend on the particular cross-linking agent, ionic strength of the composition, hydroxyl donors and the like.

The compositions of this invention must include sufficient amount of potassium ions and sodium ions to provide a weight ratio of K/Na of at least 1:1, preferably from 1:1 to 45:1, especially from about 1:1 to 3:1, more preferably from 1.05:1 to 3:1, such as 1.5:1, or 2:1. When the K/Na ratio is less than 1 there is insufficient solubility of the normally solid ingredients whereas when the K/Na ratio is more than 45, especially when it is greater than about 3, the product becomes too liquid and phase separation begins to occur. When the K/Na ratios become much larger than 45, such as in an all or mostly potassium formulation, the polymer thickener loses its absorption capacity and begins to salt out of the aqueous phase.

The potassium and sodium ions can be made present in the compositions as the alkali metal cation of the alkali metal detergent builder or alkali metal silicate or alkali metal hydroxide components of the compositions. The alkali metal cation may also be present in the compositions as a component of anionic detergent, bleach or other ionizable salt compound additive, e.g. alkali metal carbonate. In determining the K/Na weight ratios all of these sources should be taken into consideration.

Specific examples of detergent builder salts include the polyphosphates, such as alkali metal pyrophosphate, alkali metal tripolyphosphate, alkali metal metaphosphate, and the like, for example, sodium or potassium tripolyphosphate (hydrated or anhydrous), tetrasodium or tetrapotassium pyrophosphate, sodium or potassium hexa-metaphosphate, trisodium or tripotassium orthophosphate and the like, sodium or potassium carbonate, sodium or potassium citrate, sodium or potassium nitrilotriacetate, and the like. The phosphate builders, where not precluded due to local regulations, are preferred and mixtures of tetrepotassium pyrophosphate (TKPP) and sodium tripolyphosphate (NaTPP) (especially the hexahydrate) are especially preferred. Typical ratios of NaTPP to TKPP are from about 2:1 to 1:8, especially from about 1:1.1 to 1:6. The total amount of detergent builder salts is preferably from about 5 to 35% by weight, more preferably from about 15 to 35%, especially from about 18 to 30% by weight of the composition.

The linear viscoelastic compositions of this invention may, and preferably will, contain a small, but stabilizing effective amount of a long chain fatty acid or monovalent or polyvalent salt thereof. Although the manner by which the fatty acid or salt contributes to the rheology and stability of the composition has not been fully elucidated it is hypothesized that it may function as a hydrogen bonding agent or cross-linking agent for the polymeric thickener.

The preferred long chain fatty acids are the higher aliphatic fatty acids having from about 8 to 22 carbon atoms, more preferably from about 10 to 20 carbon atoms, and especially preferably from about 12 to 18 carbon atoms, inclusive of the carbon atom of the carboxyl group of the fatty acid. The aliphatic radical may be saturated or unsaturated and may be straight or branched. Straight chain saturated fatty acids are preferred. Mixtures of fatty acids may be used, such as those derived from natural sources, such as tallow fatty acid, coco fatty acid, soya fatty acid, etc., or from synthetic sources available from industrial manufacturing processes.

Thus, examples of the fatty acids include, for example, decanoic acid, dodecanoic acid, palmitic acid, myristic acid, stearic acid, behenic acid, oleic acid, eicosanoic acid, tallow fatty acid, coco fatty acid, soya fatty acid, mixtures of these acids, etc. Stearic acid and mixed fatty acids, e.g. stearic acid/palmitic acid, are preferred.

When the free acid form of the fatty acid is used directly it will generally associate with the potassium and sodium ions in the aqueous phase to form the corresponding alkali metal fatty acid soap. However, the fatty acid salts may be directly added to the composition as sodium salt or potassium salt, or as a polyvalent metal salt, although the alkali metal salts of the fatty acids are preferred fatty acid salts.

The preferred polyvalent metals are the di- and trivalent metals of Groups IIA, IIB and IIIB, such as magnesium, calcium, aluminum and zinc, although other polyvalent metals, including those of Groups IIIA, IVA, VA, IB, IVB, VB, VIB, VIIB and VIII of the Period Table of the Elements can also be used. Specific examples of such other polyvalent metals include Ti, Zr, V, Nb, Mn, Fe, Co, Ni, Cd, Sn, Sb, Bi, etc. Generally, the metals may be present in the divalent to pentavalent state. Preferably, the metal salts are used in their higher oxidation states. Naturally, for use in automatic dishwashers, as well as any other applications where the invention composition will or may come into contact with articles used for the handling, storage or serving of food products or which otherwise may come into contact with or be consumed by people or animals, the metal salt should be selected by taking into consideration the toxicity of the metal. For this purpose, the alkali metal and calcium and magnesium salts are especially higher preferred as generally safe food additives.

The amount of the fatty acid or fatty acid salt stabilizer to achieve the desired enhancement of physical stability will depend on such factors as the nature of the fatty acid or its salt, the nature and amount of the thickening agent, detergent active compound, inorganic salts, other ingredients, as well as the anticipated storage and shipping conditions.

Generally, however, amounts of the fatty acid or fatty acid salt stabilizing agents in the range of from about 0.02 to 2%, preferably 0.04 to 1%, more preferably from about 0.06 to 0.8%, especially preferably from about 0.08 to 0.4%, provide a long term stability and absence of phase separation upon standing or during transport at both low and elevated temperatures as are required for a commercially acceptable product.

Depending on the amounts, proportions and types of fatty acid physical stabilizers and polyacrylic acid-type thickening agents, the addition of the fatty acid or salt not only increases physical stability but also provides a simultaneous increase in apparent viscosity. Amounts of fatty acid or salt to polymeric thickening agent in the range of from about 0.080–0.4 weight percent fatty acid salt and from about 0.4–1.5 weight percent polymeric thickening agent are usually sufficient to provide these simultaneous benefits and, therefore, the use of these ingredients in these amounts is more preferred.

In order to achieve the desired benefit from the fatty acid or fatty acid salt stabilizer, without stabilization of excess incorporated air bubbles and consequent excessive lowering of the product bulk density, the fatty acid or salt should be post-added to the formulation, preferably together with the other surface active ingredients, including detergent active compound and anti-foaming agent, when present. These surface active ingredients are preferably added as an emulsion in water wherein the emulsified oily or fatty materials are finely and homogeneously dispersed throughout the aqueous phase. To achieve the desired fine emulsification of the fatty acid or fatty acid salt and other surface active ingredients, it is usually necessary to heat the emulsion (or preheat the water) to an elevated temperature near the melting temperature of the fatty acid or its salt. For example, for stearic acid having a melting point of 68°–69° C., a temperature in the range of between 50° C. and 70° C. will be used. For lauric acid (m.p.=47° C.) an elevated temperature of about 35° to 50° C. can be used. Apparently, at these elevated temperatures the fatty acid or salt and other surface active ingredients can be more readily and uniformly dispersed (emulsified) in the form of fine droplets throughout the composition.

In contrast, as will be shown in the examples which follow, if the fatty acid is simply post-added at ambient temperature, the composition is not linear viscoelastic as defined above and the stability of the composition is clearly inferior.

Foam inhibition is important to increase dishwasher machine efficiency and minimize destabilizing effects which might occur due to the presence of excess foam within the washer during use. Foam may be reduced by suitable selection of the type and/or amount of detergent active material, the main foam-producing component. The degree of foam is also somewhat dependent on the hardness of the wash water in the machine whereby suitable adjustment of the proportions of the builder salts, such as NaTPP which has a water softening effect, may aid in providing a degree of foam inhibition. However, it is generally preferred to include a chlorine bleach stable foam depressant or inhibitor. Particularly effective are the alkyl phosphoric acid esters of the formula

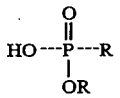

and especially the alkyl acid phosphate esters of the formula

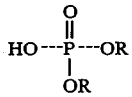

in the above formulas, one or both R groups in each type of ester may represent independently a $C_{12}$–$C_{20}$ alkyl group. The ethoxylated derivatives of each type of ester, for example, the condensation products of one mole of ester with from 1 to 10 moles, preferably 2 to 6 moles, more preferably 3 or 4 moles,
ethylene oxide can also be used. Some examples of the foregoing are commercially available, such as the products SAP from Hooker and LPKN-158 from Knapsack. Mixtures of the two types, or any other chlorine bleach stable types, or mixtures of mono- and di-esters of the same type, may be employed. Especially preferred is a mixture of mono- and di-$C_{16}$--$C_{18}$ alkyl acid phosphate esters such as monostearyl/distearyl acid phosphates 1.2/1, and the 3 to 4 mole ethylene oxide condensates thereof. When employed, proportions of 0.05 to 1.5 weight percent, preferably 0.1 to 0.5 weight percent, of foam depressant in the composition is typical, the weight ratio of detergent active component (d) to foam depressant (e) generally ranging from about 10:1 to 1:1 and preferably about 5:1 to 1:1. Other defoamers which may be used include, for example, the known silicones, such as available from Dow Chemicals. In addition, it is an advantageous feature of this invention that many of the stabilizing salts, such as the stearate salts, for example, aluminum stearate, when included, are also effective as foam killers.

Although any chlorine bleach compound may be employed in the compositions of this invention, such as dichloroisocyanurate, dichloro-dimethyl hydantoin, or chlorinated TSP, alkali metal or alkaline earth metal, e.g. potassium, lithium, magnesium and especially sodium, hypochlorite is preferred. The composition should contain sufficient amount of chlorine bleach compound to provide about 0.2 to 4.0% by weight available chlorine, as determined, for example, by acidification of 100 parts of the composition with excess hydrochloric acid. A solution containing about 0.2 to 4.0% by weight of sodium hypochlorite contains or provides roughly the same percentage of available chlorine. About 0.8 to 1.6% by weight of available chlorine is especially preferred. For example, sodium hypochlorite (NaOCl) solution of from about 11 to about 13% available chlorine in amounts of about 3 to 20%, preferably about 7 to 12%, can be advantageously used.

Detergent active material useful herein should be stable in the presence of chlorine bleach, especially hypochlorite bleach, and for this purpose those of the organic anionic, amine oxide, phosphine oxide, sulphoxide or betaine water dispersible surfactant types are preferred, the first mentioned anionics being most preferred. Particularly preferred surfactants herein are the linear or branched alkali metal mono- and/or di-($C_8$–$C_{14}$) alkyl diphenyl oxide mono- and/or di-sulphates, commercially available for example as DOWFAX (registered trademark) 3B-2 and DOWFAX 2A-1. In addition, the surfactant should be compatible with the other ingredients of the composition. Other suitable organic anionic, non-soap surfactants include the primary alkylsulphates, alkylsulphonates, alkylarylsulphonates and sec.-alkylsulphates. Examples include sodium $C_{10}$–$C_{18}$ alkylsulphates such as sodium dodecylsulphate and sodium tallow alcoholsulphate; sodium $C_{10}$–$C_{18}$ alkanesulphonates such as sodium hexadecyl-1-sulphonate and sodium $C_{12}$–$C_{18}$ alkylbenzenesulphonates such as sodium dodecylbenzenesulphonates. The corresponding potassium salts may also be employed.

As other suitable surfactants or detergents, the amine oxide surfactants are typically of the structure $R_2R^1NO$, in which each R represents a lower alkyl group, for instance, methyl, and $R^1$ represents a long chain alkyl group having from 8 to 22 carbon atoms, for instance a lauryl, myristyl, palmityl or cetyl group. Instead of an amine oxide, a corresponding surfactant phosphine oxide $R_2R^1PO$ or sulphoxide $RR^1SO$ can be employed. Betaine surfactants are typically of the structure $R_2R^1N^+R''COO$—, in which each R represents a lower alkylene group having from 1 to 5 carbon atoms. Specific examples of these surfactants include lauryl-dimethylamine oxide, myristyl-dimethylamine oxide, the corresponding phosphine oxides and sulphoxides, and the corresponding betaines, including dodecyldimethylammonium acetate, tetradecyldiethylammonium pentanoate, hexadecyldimethylammonium hexanoate and the like. For biodegradability, the alkyl groups in these surfactants should be linear, and such compounds are preferred.

Surfactants of the foregoing type, all well known in the art, are described, for example, in U.S. Pat. Nos. 3,985,668 and 4,271,030. If chlorine bleach is not used then any of the well known low-foaming nonionic surfactants such as alkoxylated fatty alcohols, e.g. mixed ethylene oxidepropylene oxide condensates of $C_8$–$C_{22}$ fatty alcohols can also be used.

The chlorine bleach stable, water dispersible organic detergent-active material (surfactant) will normally be present in the composition in minor amounts, generally about 1% by weight of the composition, although smaller or larger amounts, such as up to about 5%, such as from 0.1 to 5%, preferably from 0.3 or 0.4 to 2% by weight of the composition, may be used.

Alkali metal (e.g. potassium or sodium) silicate, which provides alkalinity and protection of hard surfaces, such as fine china glaze and pattern, is generally employed in an amount ranging from about 5 to 20 weight percent, preferably about 5 to 15 weight percent, more preferably 8 to 12% in the composition. The sodium or potassium silicate is generally added in the form of an aqueous solution, preferably having $Na_2O$:-$SiO_2$ or $K_2O$:$SiO_2$ ratio of about 1:1.3 to 1:2.8, especially preferably 1:2.0 to 1:2.6. At this point, it should be mentioned that many of the other components of this composition, especially alkali metal hydroxide and bleach, are also often added in the form of a preliminary prepared aqueous dispersion or solution.

In addition to the detergent active surfactant, foam inhibitor, alkali metal silicate corrosion inhibitor, and detergent builder salts, which all contribute to the cleaning performance, it is also known that the effectiveness of the liquid automatic dishwasher detergent compositions is related to the alkalinity, and particularly to moderate to high alkalinity levels. Accordingly, the compositions of this invention will have pH values of at least about 9.5, preferably at least about 11 to as high as 14, generally up to about 13 or more, and, when added to the aqueous wash bath at a typical concentration level of about 10 grams per liter, will provide a pH in the wash bath of at least about 9, preferably at least about 1^, such as 10.5, 11, 11.5 or 12 or more.

The alkalinity will be achieved, in part, by the alkali metal ions contributed by the alkali metal detergent builder salts, e.g. sodium tripolyphosphate, tetrapotassium pyrophosphate, and alkali metal silicate; however, it is usually necessary to include alkali metal hydroxide, e.g. NaOH or KOH, to achieve the desired high alkalinity. Amounts of alkali metal hydroxide in the range (on an active basis) of from about 0.5 to 8%, preferably from 1 to 6%, more preferably from about 1.2 to 4%, by weight of the composition will be sufficient to achieve the desired pH level and/or to adjust the K/Na weight ratio.

Other alkali metal salts, such as alkali metal carbonate may also be present in the compositions in minor amounts, for example from 0 to 4%, preferably 0 to 2%, by weight of the composition.

Other conventional ingredients may be included in these compositions in small amounts, generally less than about 3 weight percent, such as perfume, hydrotropic agents such as the sodium benzene, toluene, xylene and cumene sulphonates, preservatives, dyestuffs and pigments and the like, all of course being stable to chlorine bleach compound and high alkalinity. Especially preferred for coloring are the chlorinated phythalocyanines and polysulphides of aluminosilicate which provide, respectively, pleasing green and blue tints. $TiO_2$ may be employed for whitening or neutralizing offshades.

Although for the reasons previously discussed excessive air bubbles are not often desirable in the invention compositions, depending on the amounts of dissolved solids and liquid phase densities, incorporation of small amounts of finely divided air bubbles, generally up to about 10% by volume, preferably up to about 4% by volume, more preferably up to about 2% by volume, can be incorporated to adjust the bulk density to approximate liquid phase density. The incorporated air bubbles should be finely divided, such as up to about 100 microns in diameter, preferably from about 20 to about 40 microns in diameter, to assure maximum stability. Although air is the preferred gaseous medium for adjusting densities to improve physical stability of the composition other inert gases can also be used, such as nitrogen, carbon dioxide, helium, oxygen, etc.

The amount of water contained in these compositions should, of course, be neither so high as to produce unduly low viscosity and fluidity, nor so low as to produce unduly high viscosity and low flowability, linear viscoelastic properties in either case being diminished or destroyed by increasing tan $\geqq 1$. Such amount is readily determined by routine experimentation in any particular instance, generally ranging from 30 to 75 weight percent, preferably about 35 to 65 weight percent. The water should also be preferably deionized or softened.

The manner of formulating the invention compositions is also important. As discussed above, the order of mixing the ingredients as well as the manner in which the mixing is performed will generally have a significant effect on the properties of the composition, and in particular on product density (by incorporation and stabilization of more or less air) and physical stability (e.g. phase separation). Thus, according to the preferred practice of this invention the compositions are prepared by first forming a dispersion of the polyacrylic acid-type thickener in water under moderate to high shear conditions, neutralizing the dissolved polymer to cause gelation, and then introducing, while continuing mixing, the detergent builder salts, alkali metal silicates, chlorine bleach compound and remaining detergent additives, including any previously unused alkali metal hydroxide, if any, other than the surface-active compounds. All of the additional ingredients can be added simultaneously or sequentially. Preferably, the ingredients are added sequentially, although it is not necessary to complete the addition of one ingredient before beginning to add the next ingredient. Furthermore, one or more of these ingredients can be divided into portions and added at different times. These mixing steps should also be performed under moderate to high shear rates to achieve complete and uniform mixing. These mixing steps may be carried out at room temperature, although the polymer thickener neutralization (gelation) is usually exothermic. The composition may be allowed to age, if necessary, to cause dissolved or dispersed air to dissipate out of the composition.

The remaining surface active ingredients, including the anti-foaming agent, organic detergent compound, and fatty acid or fatty acid salt stabilizer is post-added to the previously formed mixture in the form of an aqueous emulsion (using from about 1 to 10%, preferably from about 2 to 4% of the total water added to the composition other than water added as carrier for other ingredients or water of hydration) which is pre-heated to a temperature in the range of from about Tm+5 to Tm−20, preferably from about Tm to Tm−10, where Tm is the melting point temperature of the fatty acid or fatty acid salt. For the preferred stearic acid stabilizer the heating temperature is in the range of 50° to 70° C. However, if care is taken to avoid excessive air bubble incorporation during the gelation step or during the mixing of the detergent builder salts and other additives, for example, by operating under vacuum, or using low shearing conditions, or special mixing operatus, etc., the order of addition of the surface active ingredients should be less important.

In accordance with an especially preferred embodiment, the thickened linear viscoelastic aqueous automatic dishwasher detergent composition of this invention includes, on a weight basis:

(a) 5 to 50%, preferably 15 to 30%, alkali metal detergent builder;
(b) 5 to 30, preferably 5 to 20%, alkali metal silicate;
(c) 1 to 6%, preferably 1.2 to 4%, alkali metal hydroxide;
(d) 0.1 to 3%, preferably 0.5 to 2%, chlorine bleach stable, water-dispersible, low-foaming organic detergent active material, preferably non-soap anionic detergent;

(e) 0.05 to 1.5%, preferably 0.1 to 0.5%, chlorine bleach stable foam depressant;

(f) chlorine bleach compound in an amount to provide about 0.2 to 4%, preferably 0.8 to 1.6%, of available chlorine;

(g) a high molecular weight hydrophilic alkali metal neutralized cross-linked anionic polymeric thickening agent such as a polyacrylic acid thickening agent in an amount to provide a linear viscoelasticity to the formulation, preferably from about 0.1 to 8%, more preferably from about 0.1 to 3.0% and still more preferably 0.2 to 2.0%;

(h) a long chain fatty acid or a metal salt of a long chain fatty acid in an amount effective to increase the physical stability of the compositions, preferably from 0.08 to 0.4%, more preferably from 0.1 to 0.3%; and (i) balance water, preferably from about 30 to 75%, more preferably from about 35 to 65%; and wherein in (a) the alkali metal polyphosphate includes a mixture of from about 5 to 30%, preferably from about 12 to 22% of tetrapotassium pyrophosphate, and from 0 to about 20%, preferably from about 3 to 18% of sodium tripolyphosphate, and wherein in the entire composition the ratio, by weight, of potassium ions to sodium ions is from about 1.05/1 to 3/1, preferably from 1.1/1 to 2.5/1, the compositions having an amount of air incorporated therein such that the bulk density of the composition is from about 1.32 to 1.42 g/cc, preferably from about 1.35 to 1.40 g/cc.

The compositions will be supplied to the consumer in suitable dispenser containers preferably formed of molded plastic, especially polyolefin plastic, and more preferably polyethylene, for which the invention compositions appear to have particularly favorable slip characteristics. In addition to their linear viscoelastic character, the compositions of this invention may also be characterized as pseudoplastic gels (non-thixotropic) which are typically near the borderline between liquid and solid viscoelastic gel, depending, for example, on the amount of polymeric thickener. The invention compositions can be readily poured from their containers without any shaking or squeezing, although squeezable containers are often convenient and accepted by the consumer for gel-like products.

The liquid aqueous linear viscoelastic automatic dishwasher compositions of this invention are readily employed in known manner for washing dishes, other kitchen utensils and the like in an automatic dishwasher, provided with a suitable detergent dispenser, in an aqueous wash bath containing an effective amount of the composition, generally sufficient to fill or partially fill the automatic dispenser cup of the particular machine being used.

The invention also provides a method for cleaning dishware in an automatic dishwashing machine with an aqueous wash bath containing an effective amount of the liquid linear viscoelastic automatic dishwasher detergent composition as described above. The composition can be readily poured from the polyethylene container with little or no squeezing or shaking into the dispensing cup of the automatic dishwashing machine and will be sufficiently viscous and cohesive to remain securely within the dispensing cup until shear forces are again applied thereto, such as by the water spray from the dishwashing machine.

The invention may be put into practice in various ways and a number of specific embodiments will be described to illustrate the invention with reference to the accompanying examples.

All amounts and proportions referred to herein are by weight of the composition unless otherwise indicated.

EXAMPLE 1

Figure 2:
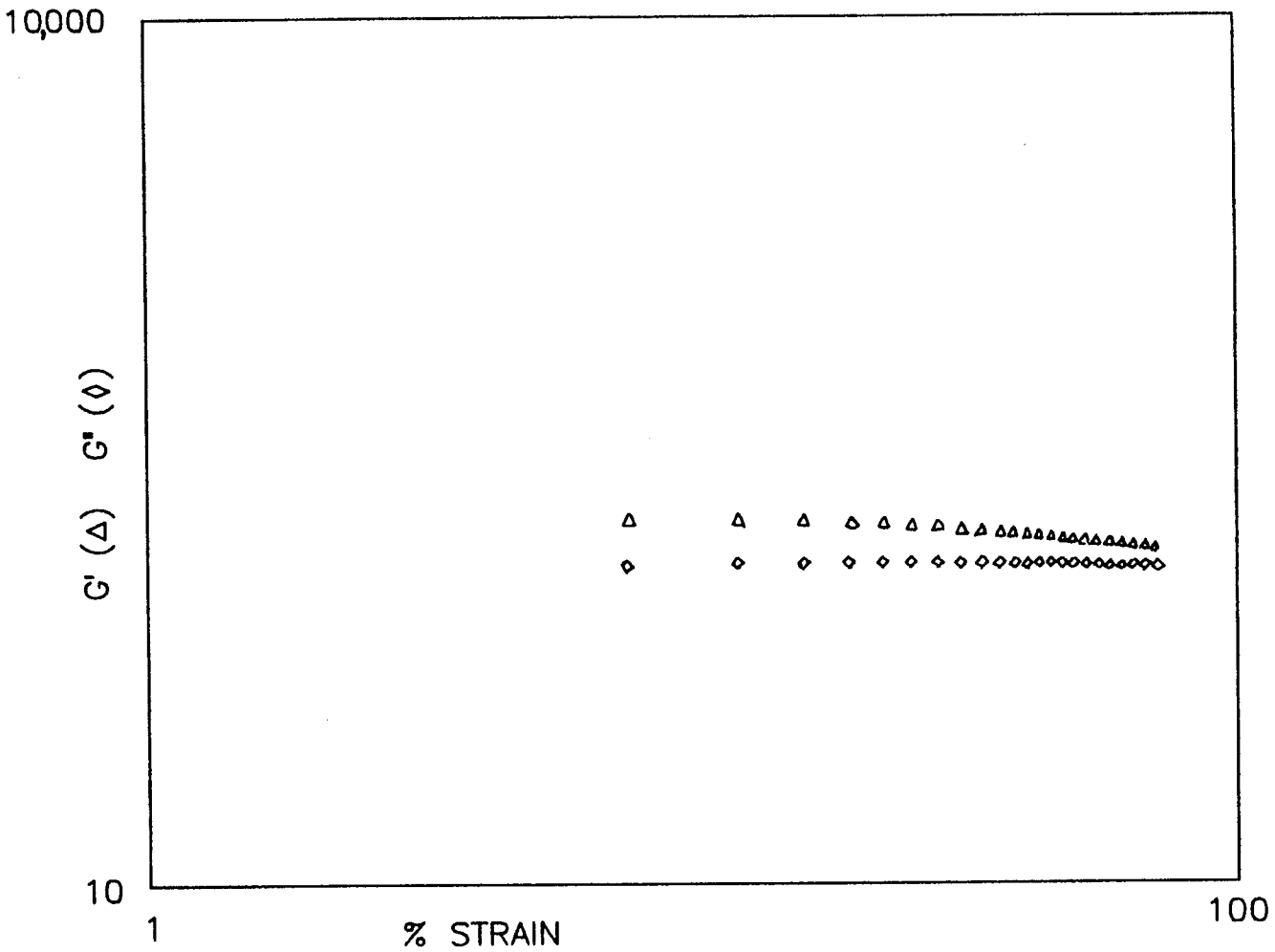
Figure 3:
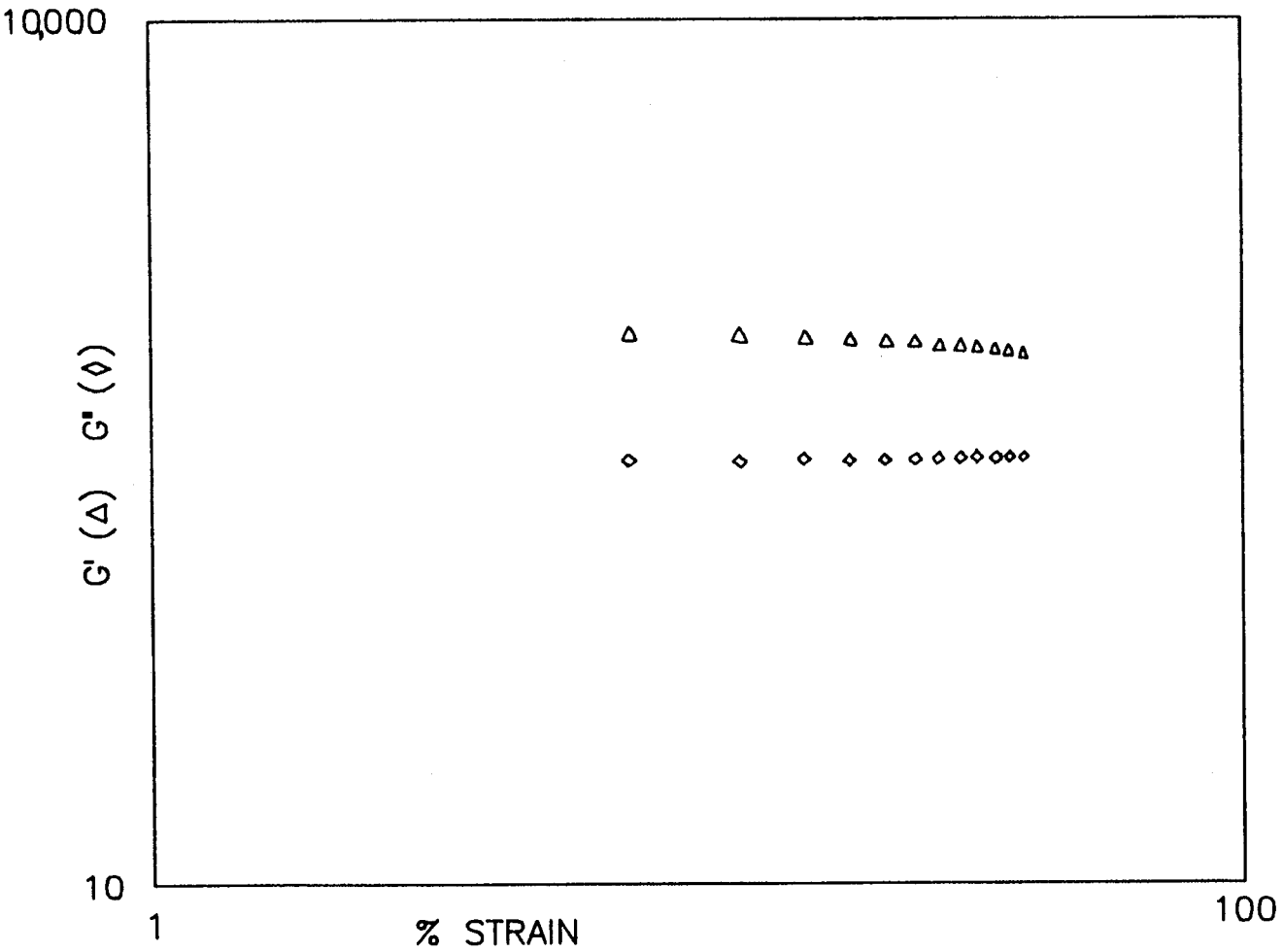
Figure 4:
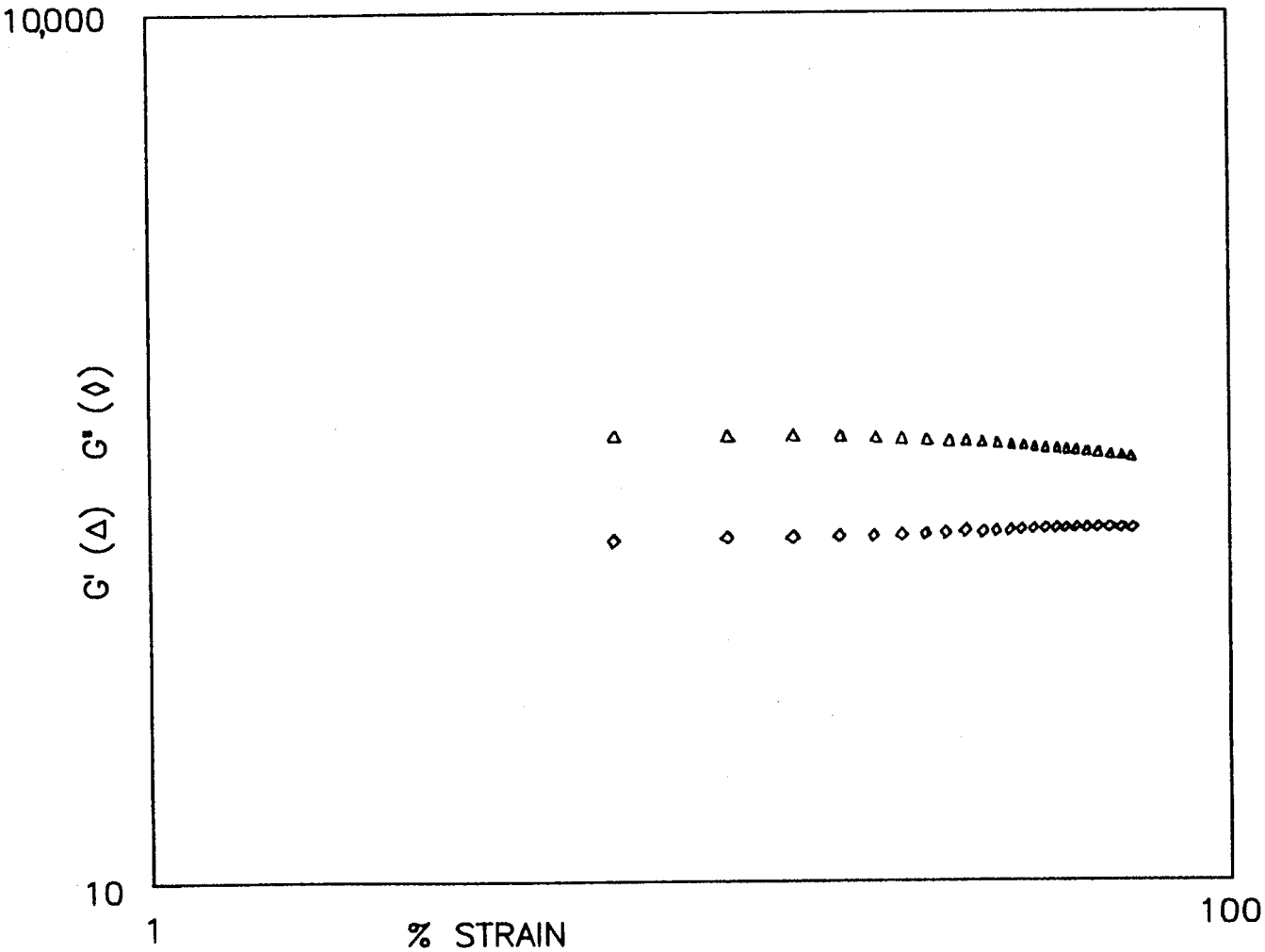
Figure 5:
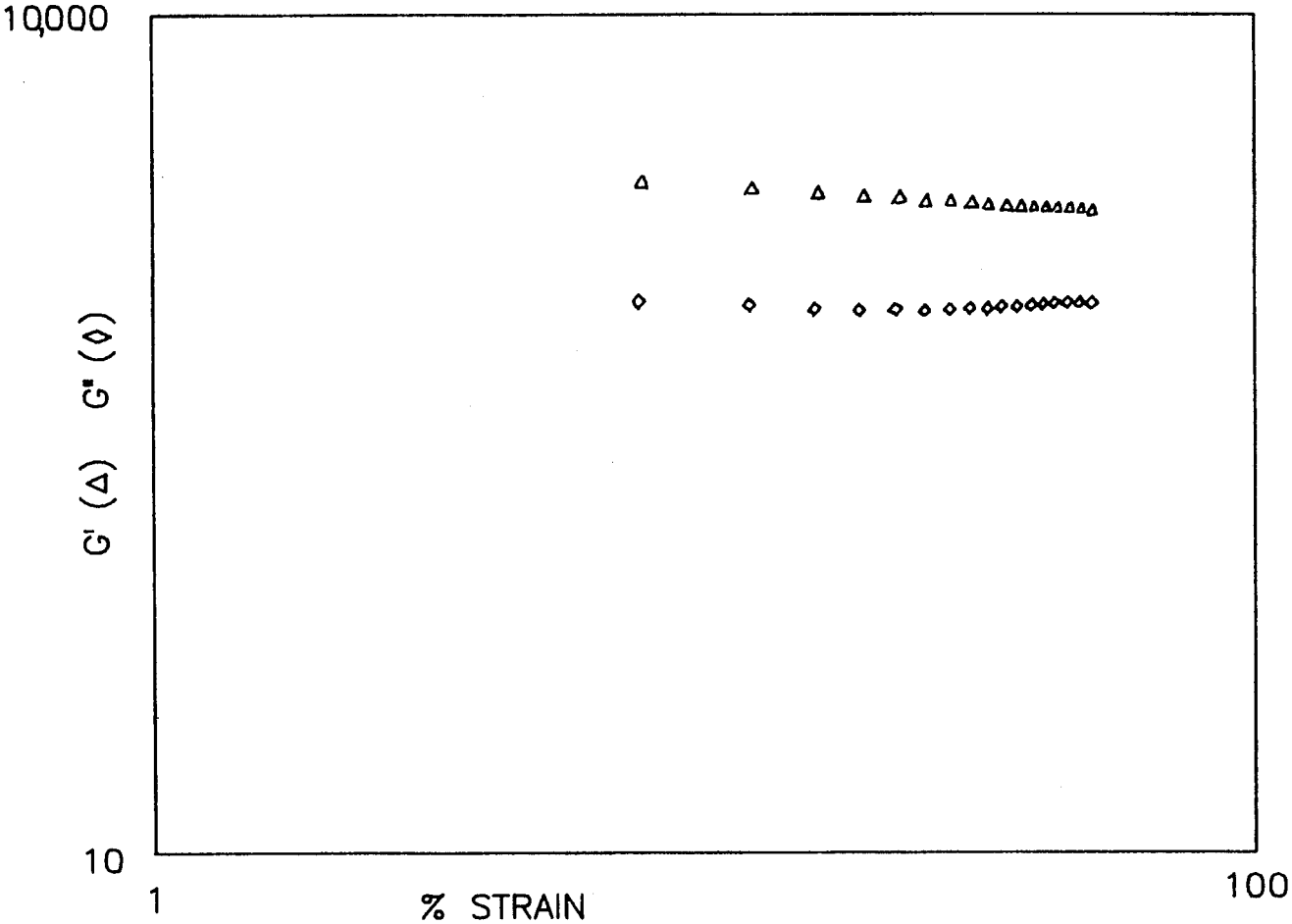
Figure 6:
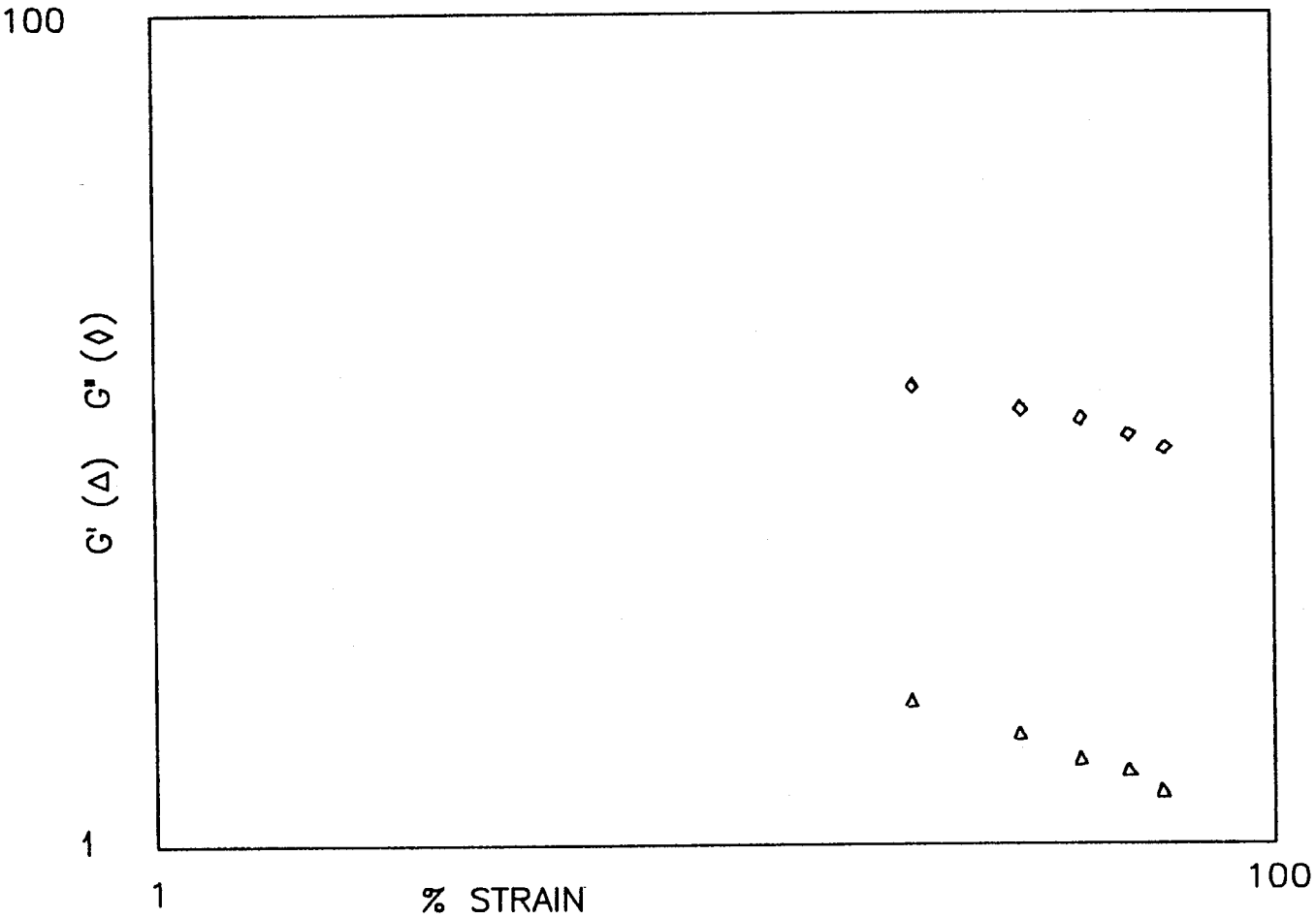
Figure 7:
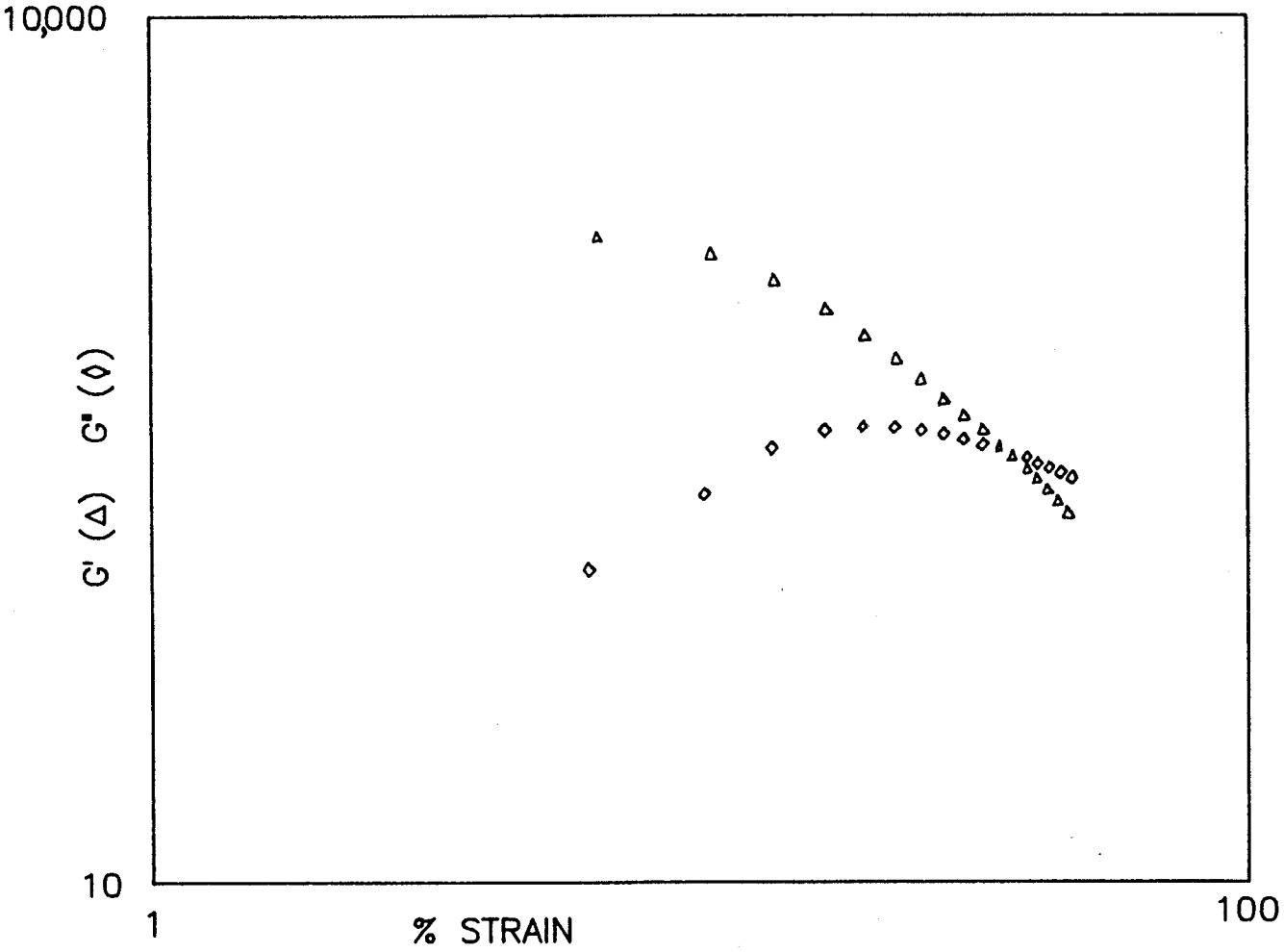
Figure 8:
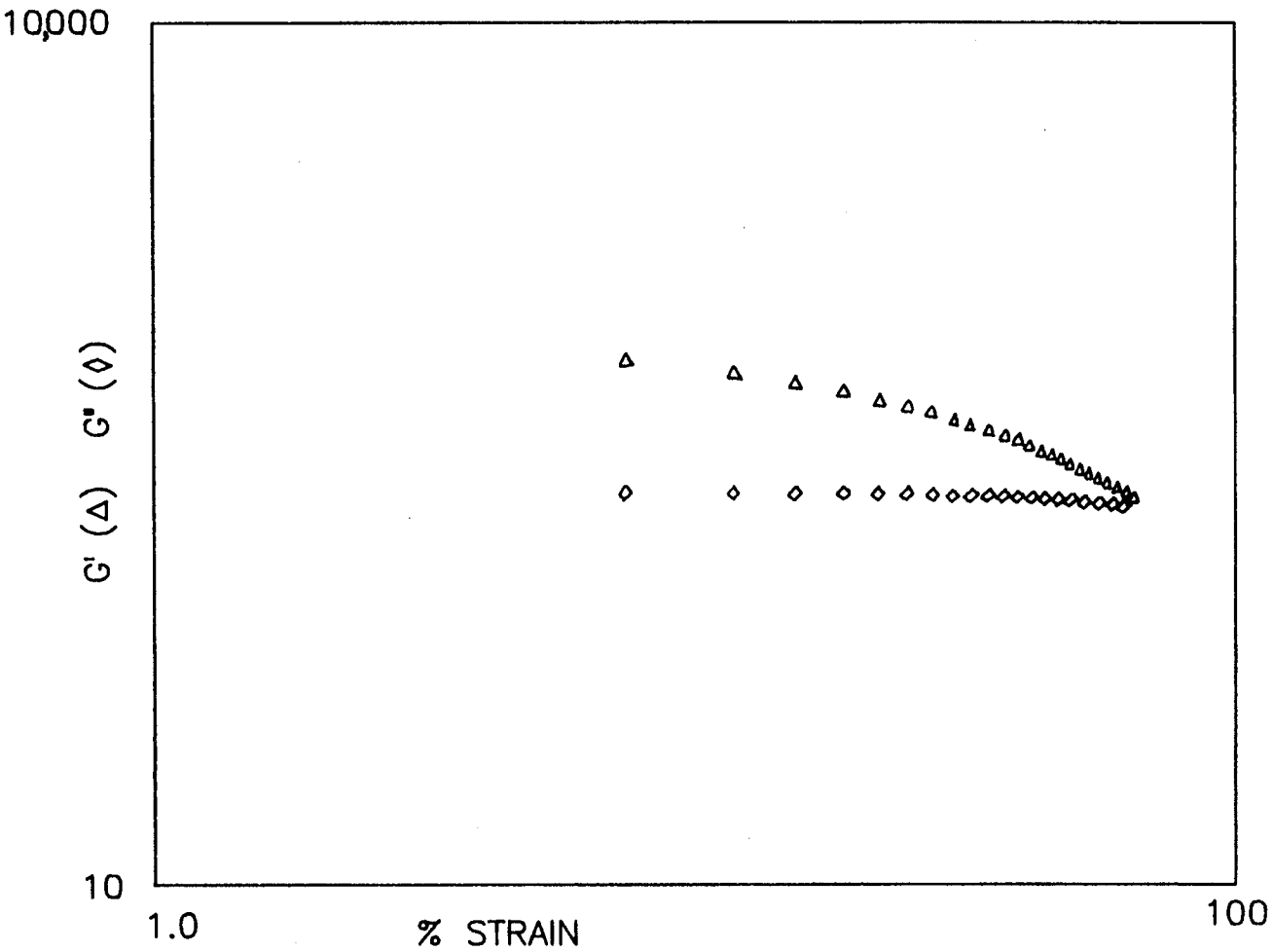

The following formulations A–K were prepared as described below:

| Ingredient/ Formulation | A | B | C | D | E | F | G | H | I | J | K |
|---|---|---|---|---|---|---|---|---|---|---|---|
| Deionized water | | | | | | Balance | | | | | |
| Carbopol 941 | 0.9 | 0.9 | 0.9 | 0.9 | 1 | — | 0.9 | 0.9 | — | 1.5 | 0.9[1] |
| NaOH (50%) | 2.4 | 2.4 | 2.4 | 2.4 | 3.5 | 3.5 | 2.4 | — | 2.4 | 2.4 | 2.4 |
| KOH (50%) | — | — | — | — | — | — | — | 2.4 | — | — | — |
| TKPP | 15 | 15 | 15 | 20 | 20 | 20 | 28 | 28 | 15 | 20 | 15 |
| TPP Hexahydrate, Na | 13 | 13 | 12 | 7.5 | 7.5 | 7.5 | — | — | 13 | 7.5 | 13 |
| Na Silicate (47.5%) (1:2.3) | 21 | 21 | 21 | 21 | 17 | 17 | 21 | — | 21 | 21 | 21 |
| K Silicate (29.1%) (1:2.3) | — | — | — | — | — | — | — | 34 | — | — | — |
| LPKN (S%) | 3.2 | 3.2 | 3.2 | 3.2 | — | — | 3.2 | 3.2 | 3.2 | 3.2 | 3.2 |
| DOWFAX 3B2 | 1 | 1 | 1 | 1 | 1 | 1 | 1 | 1 | 1 | 1 | 1 |
| Fatty Acid[2] | 0.1 | 0.1 | 0.1 | 0.1 | — | — | 0.1 | 0.1 | 1 | 0.1 | 0.1 |
| Bleach (13.0% CL) | 7.5 | 7.5 | 7.5 | 7.5 | 9.1 | 9.1 | 7.5 | 7.5 | 7.5 | 7.5 | 9 |
| Air[3] (Vol. %) | <2.0 | <2.0 | <2.0 | <2.0 | <2.0 | >2.0 | <2.0 | >2.0 | >2.0 | <2.0 | <2.0 |
| Fragrance | — | 0.17 | — | — | — | — | — | — | — | — | — |
| K/Na Ratio | 1.12 | 1.12 | 1.16 | 1.89 | 1.95 | 1.95 | 4.16 | 45.15 | — | 1.89 | — |
| Density (g/cc) | 1.37 | 1.37 | 1.35 | 1.37 | 1.36 | — | 1.37 | — | — | 1.37 | 1.37 |
| Rheogram | FIG. 1 | | FIG. 2 | FIG. 3 | | | FIG. 4 | FIG. 6 | FIG. 7 | FIG. 5 | FIG. 8 |
| Stability Results room temperature 8 weeks (%) | 0.0 | 0.0 | 0.0 | 0.0 | ≧10.0 | ≧10.0 | 0.0 | ≧20.0 | ≧5.0 | 0.0 | |
| Stability Results 100° F. | 0.0 | 0.0 | 0.0 | 0.0 | ≧10.0 | ≧10.0 | 0.0 | ≧20.0 | ≧5.0 | 0.0 | |

-continued

| Ingredient/ Formulation | A | B | C | D | E | F | G | H | I | J | K |
|---|---|---|---|---|---|---|---|---|---|---|---|
| 6 wks. (%) | | | | | | | | | | | |

[1]Carbopol 940
[2]Emersol 132 (Mixture of stearic and palmitic acid 1:1 ratio.
[3]All the formulations are aerated to a certain degree depending upon the shear condition employed for the preparation, typically the volume of air does not exceed 7–8% by volume, the preferred degree of aeration (2% by volume) resulting in the indicated densities; the air bubbles average between 20 and 60 microns in diameter.

Formulations A, B, C, D, E, G, J, and K are prepared by first forming a uniform dispersion of the Carbopol 941 or 940 thickener in about 97% of the water (balance). The Carbopol is slowly added to deionized water at room temperature using a mixer equipped with a premier blade, with agitation set at a medium shear rate, as recommended by the manufacturer. The dispersion is then neutralized by addition, under mixing, of the caustic soda (50% of NaOH or KOH) component to form a thickened product of gel-like consistency.

To the resulting gelled dispersion the silicate, tetrapotassium pyrophosphate (TKPP), sodium tripolyphosphate TP (TPP, Na) and bleach, are added sequentially, in the order stated, with the mixing continued at medium shear.

Separately, an emulsion of the phosphate anti-foaming agent (LPKN), stearic acid/palmitic acid mixture and detergent (Dowfax 3B2) is prepared by adding these ingredients to the remaining 3% of water (balance) and heating the resulting mixture to a temperature in the range of 50° C. to 70° C.

This heated emulsion is then added to the previously prepared gelled dispersion under low shear conditions, such that a vortex is not formed.

The remaining formulations F, H and I are prepared in essentially the same manner as described above except that the heated emulsion of LPKN, stearic acid and Dowfax 3B2 is directly added to the neutralized Carbopol dispersion prior to the addition of the remaining ingredients. As a result, formulations F, H and I, have higher levels of incorporated air and densities below 1.30 g/cc.

The rheograms for the formulations A, C, D, G and J are shown in FIGS. 1–5, respectively, and rheograms for formulations H, I and K are shown in FIGS. 6, 7 and 8, respectively.

These rheograms are obtained with the System 4 Rheometer from Rheometrics equipped with a Fluid Servo with a 100 grams-centimeter torque transducer and a 50 millimeter parallel plate geometry having an 0.8 millimeter gap between plates. All measurements are made at room temperature 25°+1° C.) in a humidity chamber after a 5 minute or 10 minute holding period of the sample in the gap. The measurements are made by applying a frequency of 10 radians per second.

All of the composition formulations A, B, C, D, G and J according to the preferred embodiment of the invention which include Carbopol 941 and stearic acid exhibit linear viscoelasticity as seen from the rheograms of FIG. 1–5. Formulation E which includes Carbopol 941 but not stearic acid showed no phase separation at either room temperature or 100° F. after 3 weeks, but exhibited 10% phase separation after 8 weeks at room temperature and after only 6 weeks at 100° F.

EXAMPLE 2

This example demonstrates the importance of the order of addition of the surface active component premix to the remainder of the composition on product density and stability.

The following formulations are prepared by methods A and B:

| Ingredient | |
|---|---|
| Water, deionized | Balance |
| Carbopol 941 | 0.5 |
| NAOH (50%) | 2.4 |
| Na Silicate (47.5%) | 21 |
| TKPP | 15 |
| TPP, Na | 13 |
| Bleach (1%) | 7.5 |
| LPKN | 0.16 |
| Stearic Acid | 0.1 |
| Dowfax 3B2 | 1 |

Method A

The Carbopol 941 is dispersed, under medium shear rate, using a premier blade mixer, in deionized water at ambient temperature. The NaOH is added, under mixing, to neutralize and gel the Carbopol 941 dispersion. To the thickened mixture the following ingredients are added sequentially while the stirring is continued: sodium silicate, TKPP, TPP, and bleach.

Separately, an emulsion is prepared by adding the Dowfax 3B2, stearic acid and LPKN to water while mixing at moderate shear and heating the mixture to about 65° C. to finely disperse the emulsified surface active ingredients in the water phase. This emulsion premix is then slowly added to the Carbopol dispersion while mixing under low shear conditions without forming a vortex. The results are shown below.

Method B

Method A is repeated except that the heated emulsion premix is added to the neutralized Carbopol 941 dispersion before the sodium stearate, TKPP, TPP, and bleach. The results are also shown below.

Figure 9:
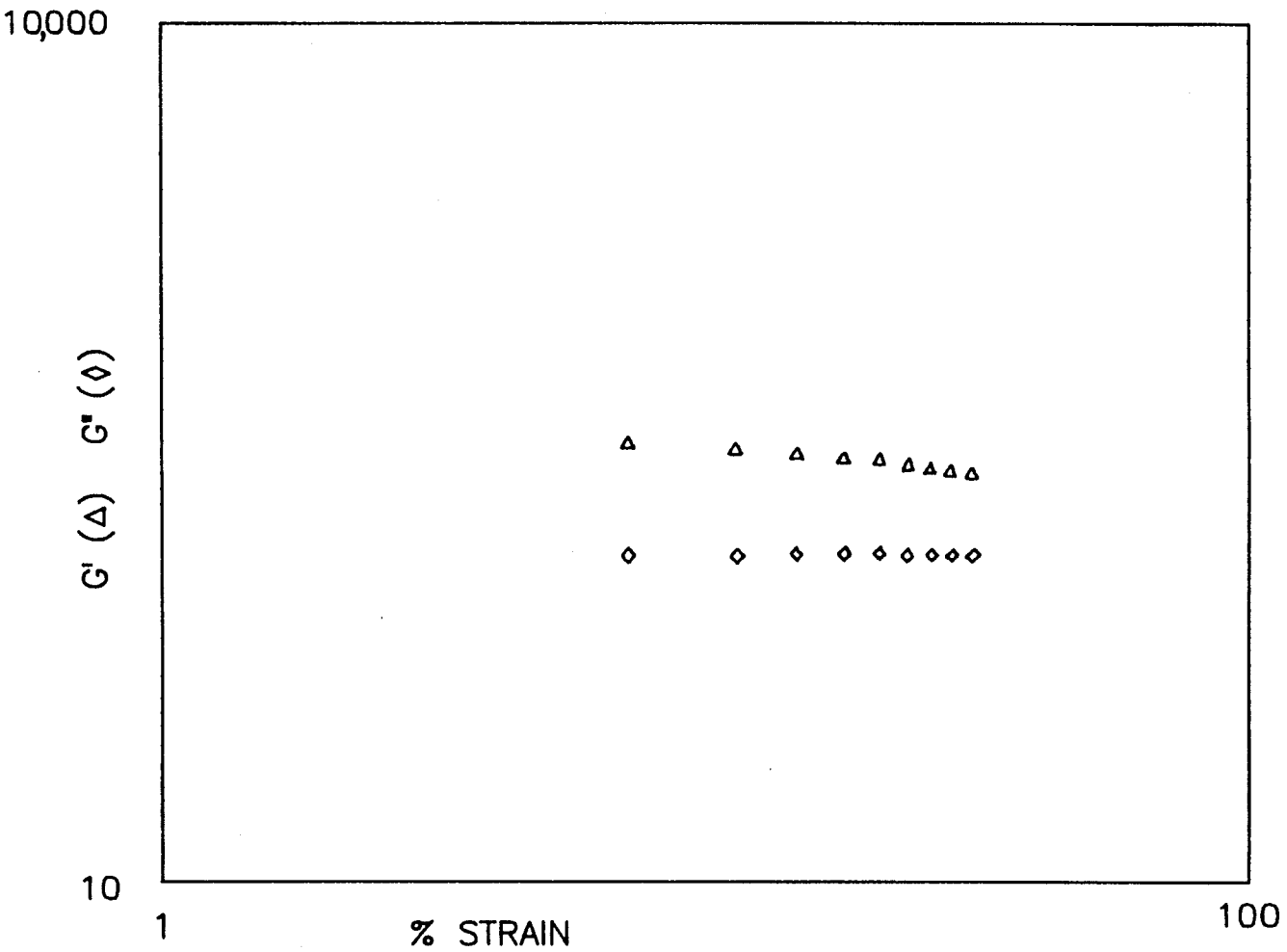
Figure 10:
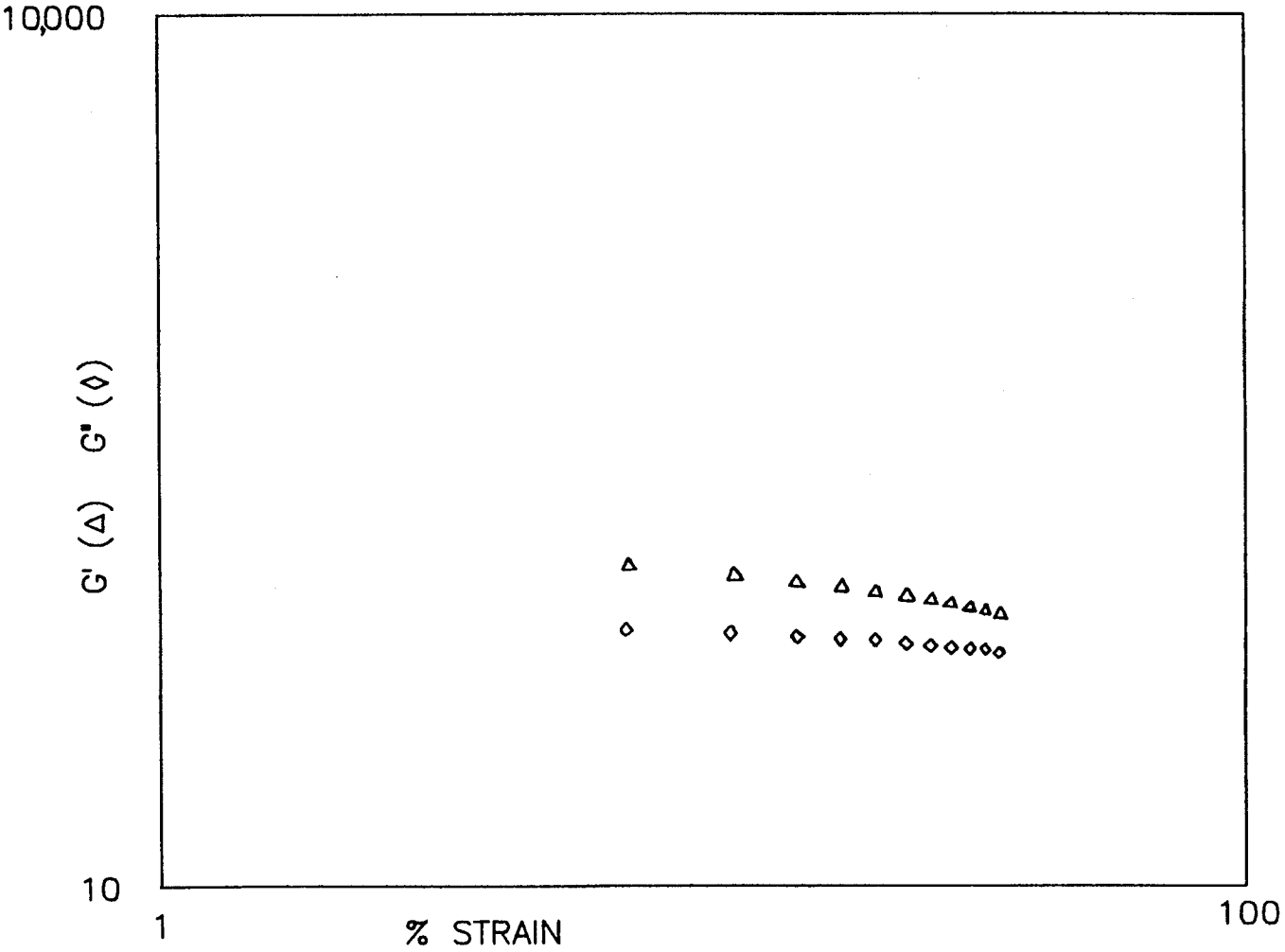

| | Method A | Method B |
|---|---|---|
| Density | 1.38 | 1.30 |
| Stability (RT-8 weeks) | 0.00% | 7.00% |
| Rheogram | FIG. 9 | FIG. 10 |

From the rheograms of FIGS. 9 and 10 it is seen that both products are linear viscoelastic although the elastic and viscous moduli G′ and G″ are higher for Method A than for Method B.

From the results it is seen that early addition of the surface active ingredients to the Carbopol gel significantly increases the degree of aeration and lowers the bulk density of the final product. Since the bulk density is lower than the density of the continuous liquid phase, the liquid phase undergoes inverse separation (a clear liquid phase forms on the bottom of the composition). This process of inverse separation appears to be kinetically controlled and will occur faster as the density of the product becomes lower.

EXAMPLE 3

This example shows the importance of the temperature at which the premixed surfactant emulsion is prepared.

Two formulations, L and M, having the same composition as in Example 2 except that the amount of stearic acid was increased from 0.1% to 0.2% are prepared as shown in Method A for formulation L and by the following Method C for formulation M.

Method C

Figure 11:
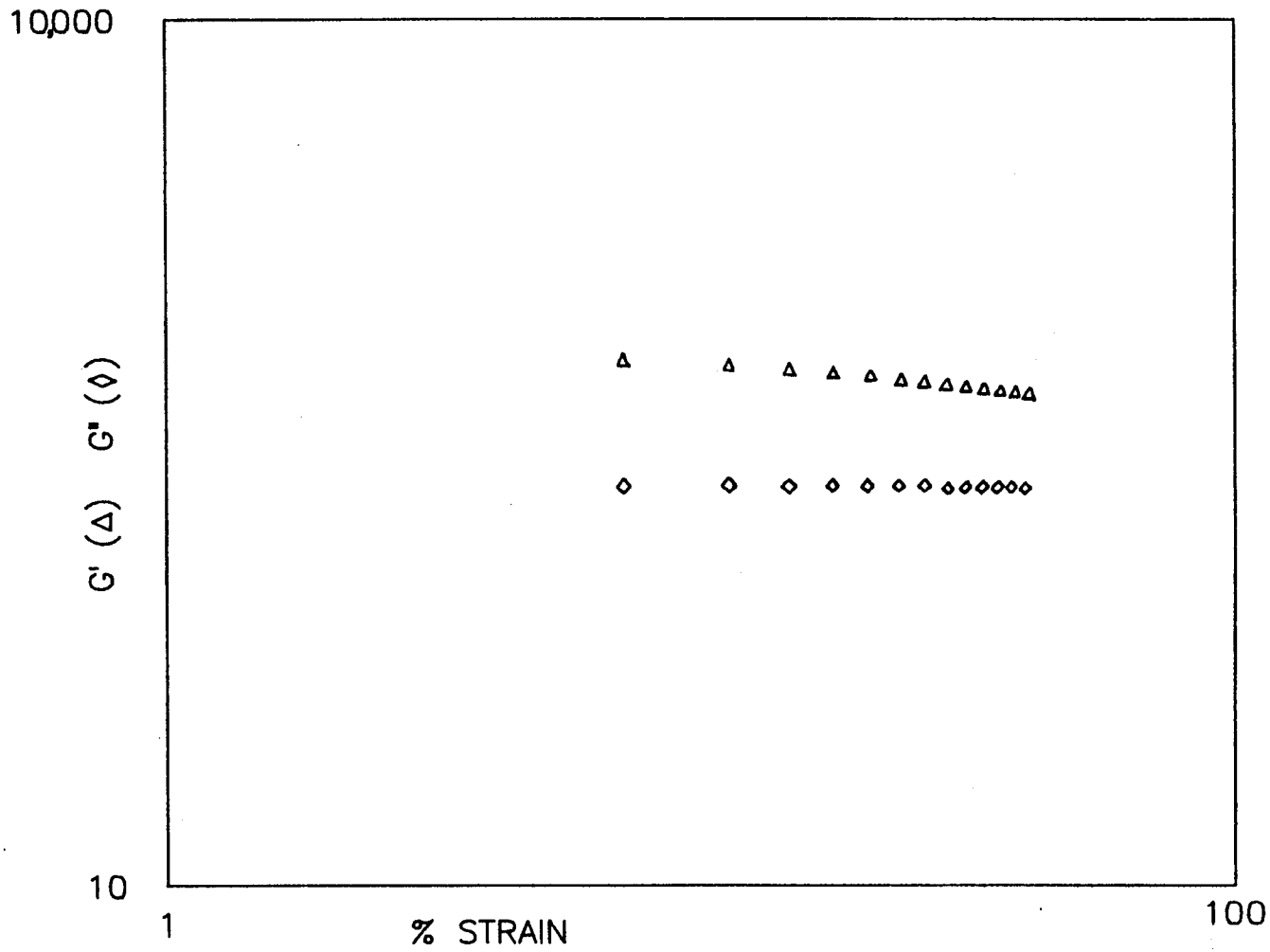
Figure 12:
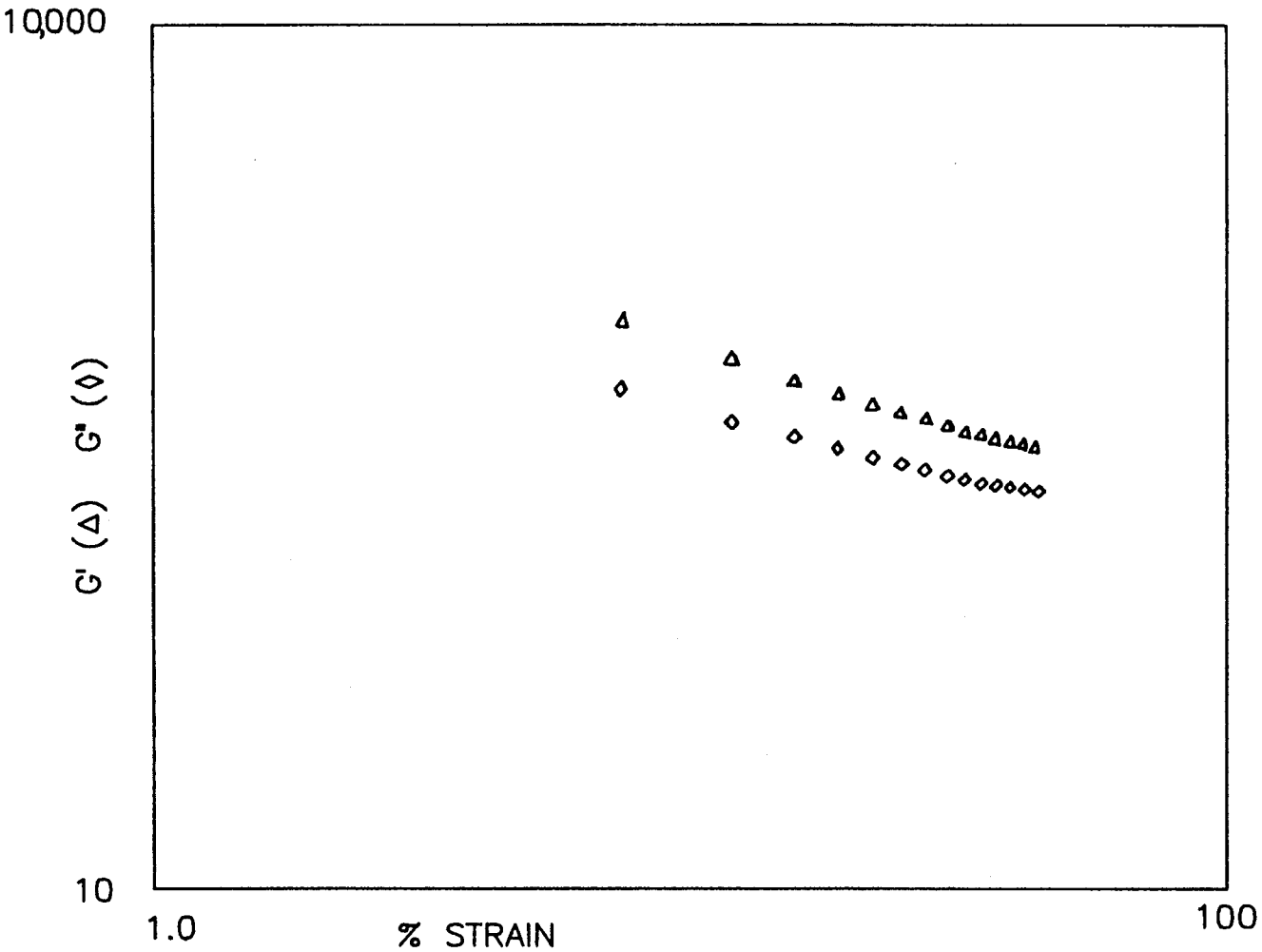

The procedure of Method A is repeated in all details except that emulsion premix of the surface active ingredients is prepared at room temperature and is not heated before being post-added to the thickened Carbopol dispersion containing silicate, builders and bleach. The rheograms for formulations L and M are shown in FIGS. 11 and 12, respectively. From these rheograms it is seen that formulation L is linear viscoelastic in both G′ and G″ whereas formulation M is nonlinear viscoelastic particularly for elastic modulus G′ (G′ at 1% strain-G′ at 30% strain>500 dynes/cm$^2$) and also for G″ (G″ at 1% strain-G″ at 30% strain=300 dynes/cm$^2$).

Formulation L remains stable after storage at RT and 100° F. for at least 6 weeks whereas formulation M undergoes phase separation.

COMPARATIVE EXAMPLE 1

The following formulation is prepared without any potassium salts:

| | Weight % |
|---|---|
| Water | Balance |
| Carbopol 941 | 0.2 |
| NaOH (50%) | 2.4 |
| TPP, Na (50%) | 21.0 |
| Na Silicate (47.5%) | 17.24 |
| Bleach (1%) | 7.13 |
| Stearic Acid | 0.1 |
| LPKN (5%) | 3.2 |
| Dowfax 3B2 | 0.8 |
| Soda Ash | 5.0 |
| Acrysol LMW 45-N | 2.0 |

Figure 13:
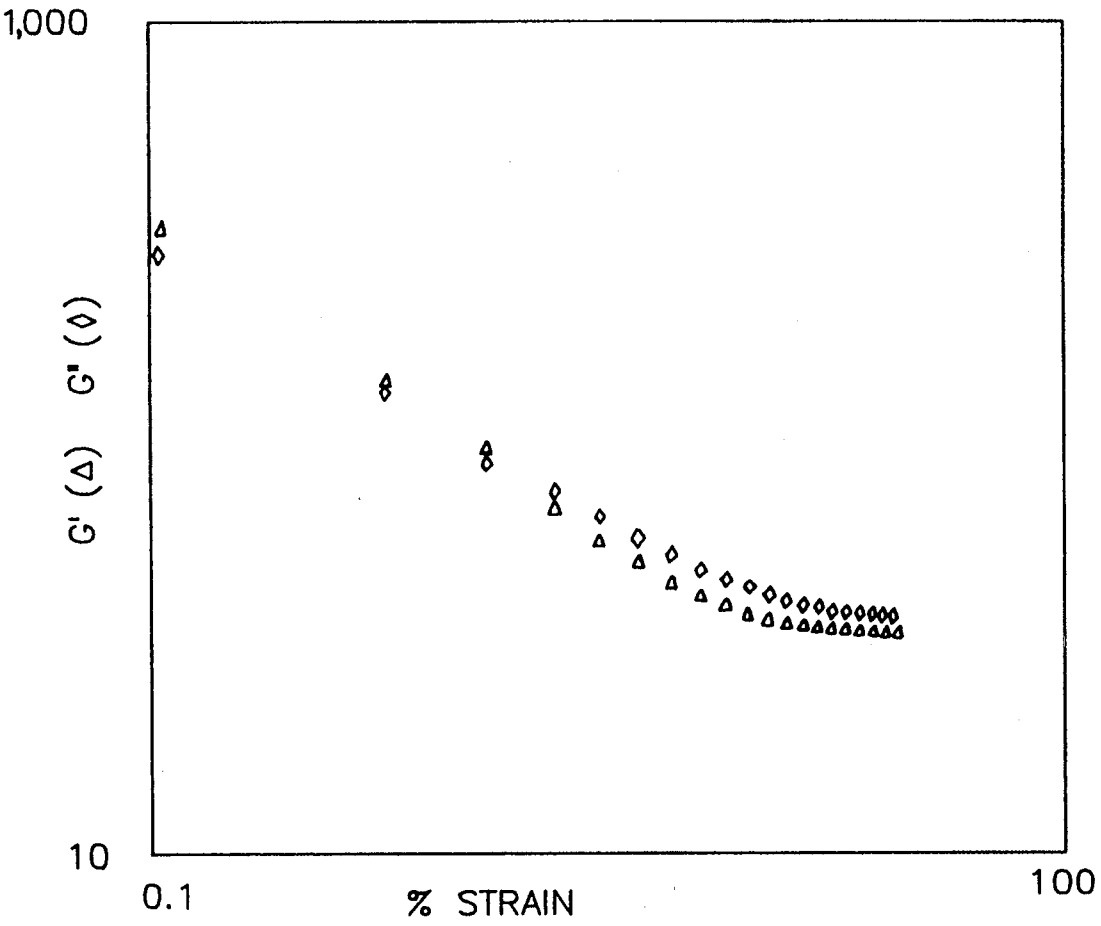

The procedure used is analogous to Method A of Example 2 with the soda ash and Acrysol LMW 45-N (low molecular weight polyacrylate polymer) being added before and after, respectively, the silicate, TPP and bleach, to the thickened Carbopol 941 dispersion, followed by addition of the heated surface active emulsion premix. The rheogram is shown in FIG. 13 and is non-linear with G″/G′ (tan )>1 over the range of strain of from about 5% to 80%.

EXAMPLE 4

Formulations A, B, C, D and K according to this invention and comparative formulations F and a commercial liquid automatic dishwasher detergent product as shown in Table 1 above were subjected to a bottle residue test using a standard polyethylene 28 ounce bottle as used for current commercial liquid dishwasher detergent bottle.

Six bottles are filled with the respective samples and the product is dispensed, with a minimum of force, in 80 gram dosages, with a 2 minute rest period between dosages, until flow stops. At this point, the bottle was vigorously shaken to try to expel additional product.

The amount of product remaining in the bottle is measured as a percentage of the total product originally filled in the bottle. The results are shown below.

| Bottle Residue | |
|---|---|
| Formulation | Residue |
| A | 8 |
| B | 10 |
| C | 6 |
| D | 5 |
| K | 7 |
| F* | 4 |
| Commercial Product | ≧20 |

*The sample separates upon aging.

EXAMPLE 5

Figure 14:
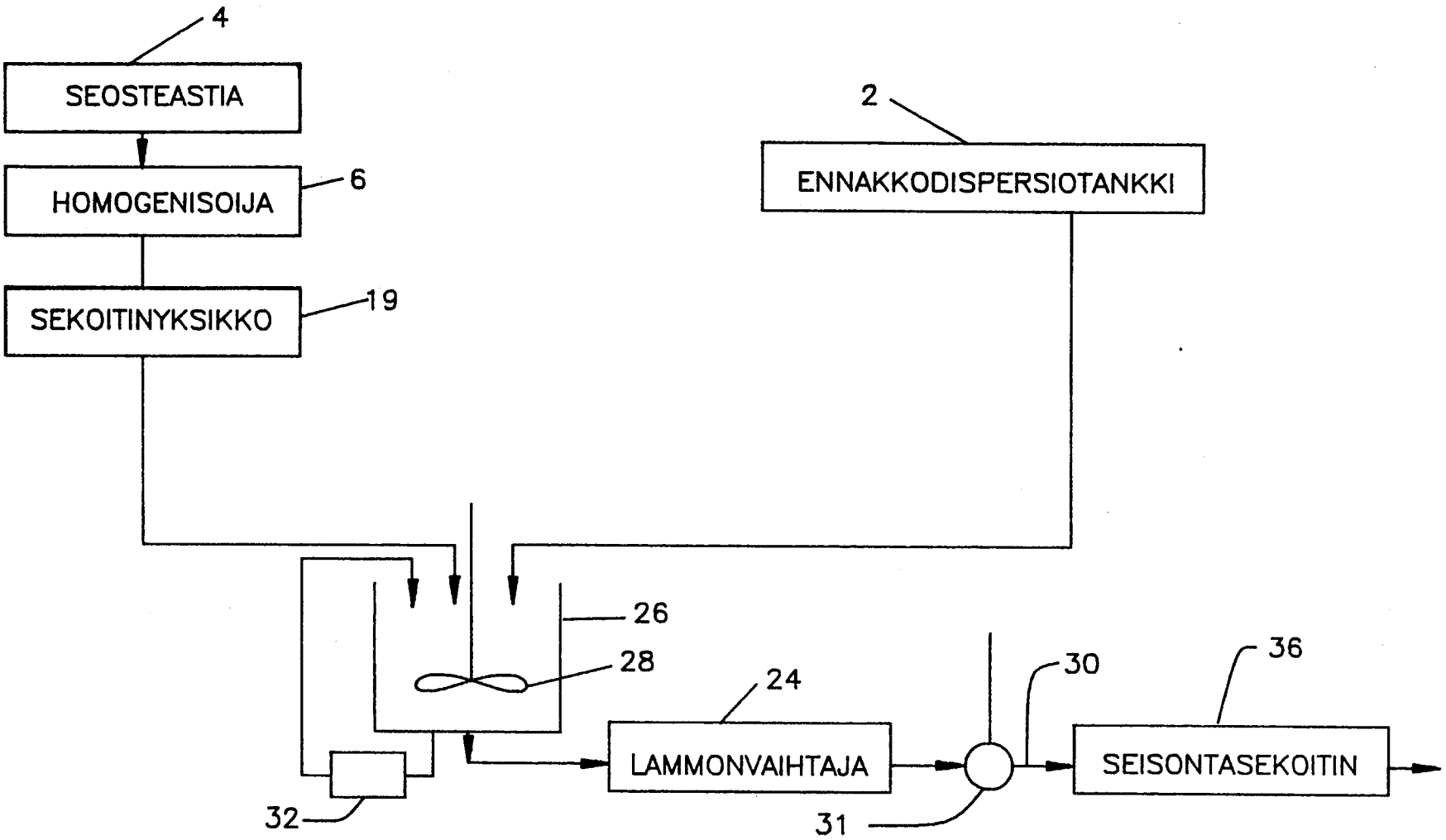
FIG. 14 illustrates a schematic diagram of the most preferred process.
Figure 15:
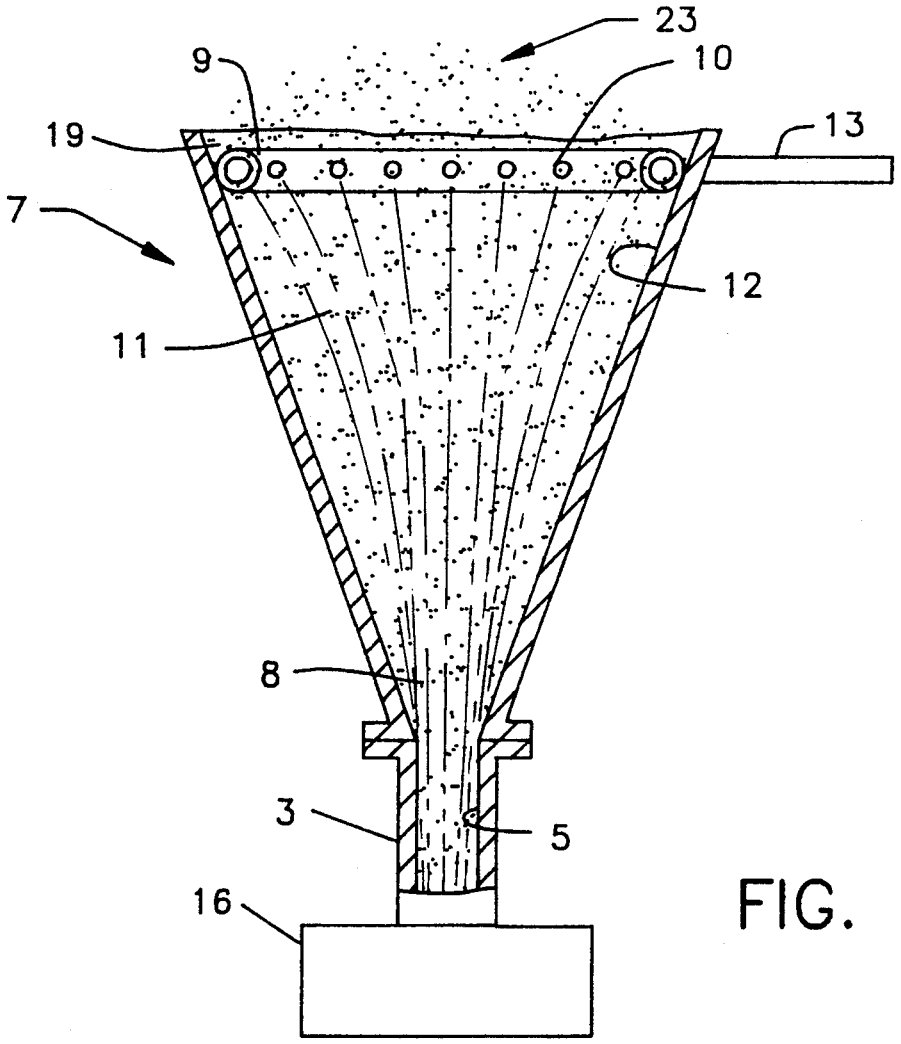
FIG. 15 illustrates a from B cutaway view of a vibrating feeder.
Figure 16:
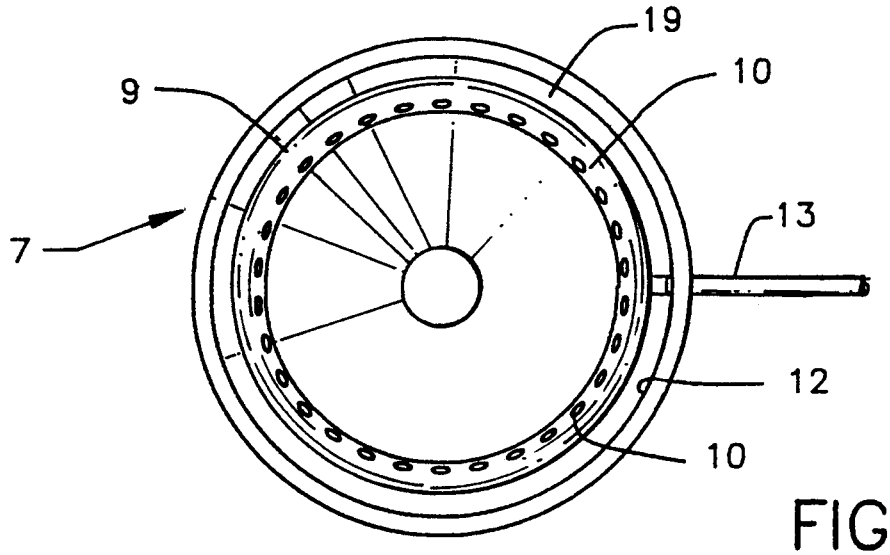
FIG. 16 illustrates a top view of the vibrating feeder.
Figure 14:
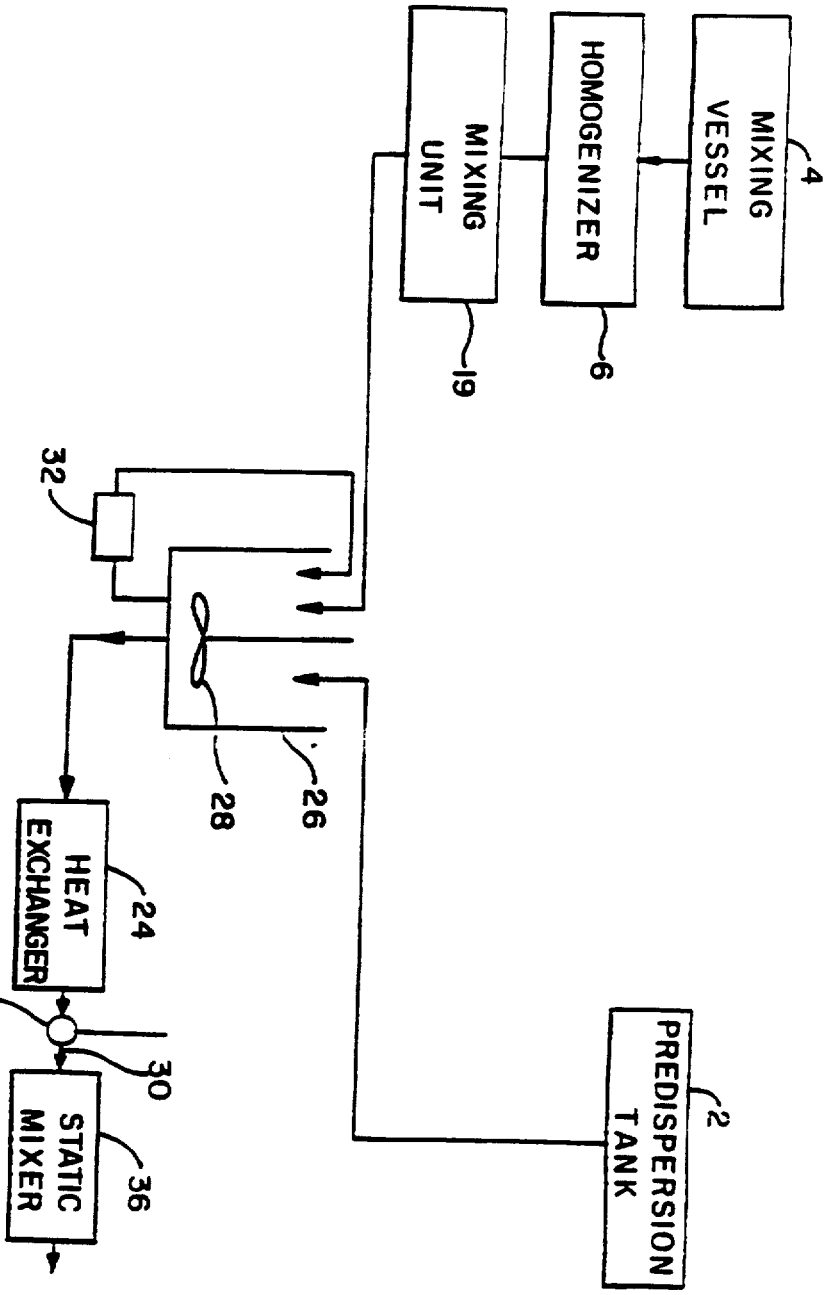

The most preferred process as depicted on FIGS. 14–16 was used to prepare the composition of Example 5 for the manufacture of the viscoelastic gel compositions of the instant invention comprises the steps of:

(a) forming a predispersion of at least one surfactant, a fatty acid or an alkali metal salt of a fatty acid and a defoamer which comprises the steps of:
  (i) adding deionized water at a temperature of about 170° F. to about 210° F., more preferably about 170° F. to 190° F. and most preferably about 175° F. to about 185° F., to a predispersion tank (2);
  (ii) adding the surfactant or surfactants with stirring to the deionized water in the predispersion tank (2), wherein the concentration of the surfactant is about 30 to about 40 wt. %;
  (iii) heating the defoamer to a temperature above the melting point of the defoamer to transform the defoamer into a molten defoamer;
  (iv) adding the molten defoamer with stirring to the mixture of the deionized water and at least one surfactant in the predispersion tank (2), wherein the concentration of the defoamer is about 5 to about 9 wt. %;
  (v) heating the fatty acid and/or the alkali metal salt of the fatty acid to a temperature above the melting point of the fatty acid and/or alkali metal salt of the fatty acid to transform the fatty acid and/or alkali metal salt of the fatty acid into a molten fatty acid and/or a molten alkali metal salt of a fatty acid;
  (vi) adding with stirring the molten fatty acid and/or molten alkali metal salt of the fatty acid to the mixture of deionized water, at least one surfactant and defoamer in the predispersion to form in the predispersion tank (2) a predispersion solution of the deionized water, at least one surfactant, defoamer and fatty acid and/or alkali metal salt of the fatty acid; wherein the concentration of the fatty acid and/or alkali metal salt of the fatty acid is about 1.0 to about 5.0 wt. %;
  (vii) continuing stirring the predispersion solution in the predispersion tank (2) for a sufficient period of time to ensure a uniform predispersion solution, preferably for about 1 to 30 minutes, more preferably about 2 to about 15 minutes, and most preferably about 3 to about 10 minutes;

(b) forming a polymer premix solution which comprises the steps of:

(i) mixing at least one cross-linked polyacrylic acid thickening agent such as Carbopol 941, Carbopol 940, Carbopol 614 and/or Carbopol 624 with deionized water in a mixing vessel (4) at a temperature of about 50° F. to about 80° F., most preferably at about 50° F. to about 75° F.; and (ii) transferring the mixture of the polyacrylic acid thickening agent and the deionized water from the mixing vessel (4) into a premix tank agitator (6) or in line homogenizer (6) to further mix and dearate the premix solution to the solution has obtained a Brookfield viscosity at room temperature using a #6 spindle at 50 rpms of about 10,000 cps to about 60,000 cps, more preferably about 15,000 cps to about 50,000 cps wherein the unneutralized premix solution has less than 2.0 volume % of entrained air bubbles, more preferably less than 1.5 volume % and most preferably less than 1.0 volume %.

An especially preferred method of forming the unneutralized premix solution of the polyacrylic acid thickening agent and the deionized water is to employ a funnel shaped vibrating feeder (7) as depicted in FIGS. 15 and 16 that has a bottom opening (8) at the bottom of the feeder (7) and a ring (9) with a bore (not shown) continuous there through and a plurality of water inlet apertures (10), wherein the ring (9) is joined to a water inlet source (13) and the ring (9) is affixed to the upper inner surface (12) of the feeder (7) at a point just below the upper rim (15) of the feeder (7) which has an open top (19). A continuous stream (11) of water comes from aperature (10) of the ring (9) and cascades down the inner surface (12) of the feeder (7) towards the bottom opening (8) of the feeder (7). Alternative to the ring (9) with aperature (10) other water delivery means are contemplated such as a spray assembly positioned over the open top the feeder (7). The solid polyacrylic acid thickening agent (23) is dropped from above the feeder (7) into the feeder (7) and the thickening agent (23) contacts the stream (11) of water on the inner surface (12) of the feeder (7) and the thickening agent is wet by the stream of water and forms a mixture of the thickening agent and the water, wherein the mixture is continuously discharged through the bottom opening (8) of the feeder (7) through a cylindrical shaped member (3) having a bore (5) therethrough, wherein the cylindrical shaped member (3) is joined at one end to the bottom of the feeder (7) and at the other end to a Dilumett homogeneous mixer (16), into an in line Dilumett homogenous mixer (16) sold by Arde-Barinco or alternatively a Dispac-Reactor which is a 3 stage rotor/static homogenizer sold by IKA Co. of Germany or any other suitable in line homogenous mixers and the unneutralized premix solution is pumped to premix mixing tank, wherein the resultant Brookfield viscosity at room temperature at a #6 spindle at 50 rpms is about 10,000 cps to about 60,000 cps, more preferably about 15,000 cps to about 50,000 cps, wherein the unneutralized premix solution has less than 20 volume % of entrained air bubbles, more preferably less than about 1.5 volume % and most preferably less than 1.0 volume %.

(c) neutralizing the polyacrylic acid thickening agent in the unneutralized premix solution which comprises the step of adding to the unneutralized premix solution a sufficient amount of preferably an alkali metal silicate or alternative the alkali metal detergent builder such as an alkali metal polyphosphate or an alkali metal nonphosphate builder salt to substantially neutralize the polyacrylic acid thickening agent in a neutralizing mixing unit (19) to form a neutralized premix solution. The preferred method of neutralizing consists of mixing the premix solution of the polyacrylic acid thickening agent and deionized water in a neutralization mixing unit (19), wherein the concentration of the polyacrylic acid thickening agent in the premix solution is about 0.25 to about 10 wt. %, more preferably about 1.0 to about 9.0 wt. %, and most preferably about 2.0 to about 8.0 wt. %, with an aqueous solution of the alkali metal silicate, wherein the concentration of the alkali metal silicate in the aqueous solution is about 40 to about 70 wt. %, and an in line static mixer is the neutralization mixing unit (19). The resultant neutralized premix solution of the neutralized polyacrylic acid thickening agent alkali metal silicate and/or an alkali metal detergent builder salt and deionized water has a Brookfield viscosity at room temperature at a #2 spindle at 50 rpms of about 1,000 cps to about 20,000 cps, more preferably about 1,500 cps to about 15,000 cps and most preferably about 2,000 cps to about 10,000 cps and the pH of the neutralized premix solution is at least about 10, more preferably at least about 10.5 and most preferably at least about 11.0;

(d) Forming the viscoelastic gel composition in a main mixing vessel (26) having a stirrer unit (28) which comprises the steps of:

(i) Adding deionized water at a temperature of about 45° F. to about 80° F., more preferably about 50° F. to about 75° F., to the main mixing vessel (26);

(ii) optionally, adding with stirring a colorant to the deionized water in the main mixing vessel (26);

(iii) adding the neutralized premix solution with stirring to the main mixing vessel (26);

(iv) adding an aqueous solution of an alkali metal hydroxide such as sodium hydroxide, wherein the concentration of the alkali metal hydroxide in the aqueous solution is about 20 to about 60 wt. %, with stirring to the mixture of deionized water and neutralized premix solution in the main mixing vessel (26);

(v) adding an aqueous solution of potassium tripolyphosphate, wherein the concentration of the potassium tripolyphosphate in the aqueous solution is about 50 to 70 wt. %, with stirring to the mixture of deionized water, neutralized premix solution and alkali metal hydroxide in the main mixing vessel (26) wherein it is understood that potassium polypyrophosphate can be readily employed in place of potassium tripolyphosphate;

(vi) adding anhydrous sodium tripolyphosphate with stirring to the mixture of deionized water, neutralized premix solution, alkali metal hydroxide and potassium tripolyphosphate in the main mixing vessel (26) wherein it is understood that the alkali metal silicate can be employed in (v) or (vi) and the alkali metal phosphate can be employed in step (c) as the neutralizing agent; and (vii) adding the predispersion solution with mixing to the mixture of the deionized water, neutralized premix solution, alkali metal hydroxide, potassium tripolyphosphate, sodium tripolyphosphate to form a solution (A) of the deionized water, neutralized polyacrylic acid thickening agent, alkali metal hydroxide, sodium tripolyphosphate, potassium tripolyphosphate, alkali metal silicate, at least one surfactant, defoamer and fatty acid and/or alkali metal salt of the fatty acid, wherein if any fatty acid was employed, the fatty acid at this point in the process has been neutralized in situ to the alkali metal salt of the fatty acid;

(e) transferring solution (A) through a heat exchanger system (32) to increase the temperature of solution (A) to about 140° F. to about 200° F., more preferably about 145° F. to about 165° F., and recycling said solution (A) into the main mixing vessel (26);

(f) adding the heated solution (A) in the main mixing vessel (26) with stirring an aqueous solution of an alkali metal hypochlorite such as NaOCl, wherein the aqueous solution of NaOCl contains about 5 to about 50 wt. % of NaOCl, more preferably about 7.0 to about 25 wt. %, to form solution (B) which comprises solution (A) together with the alkali metal hypochlorite;

(g) cooling the solution (B) through an in line cooling heat exchanger (24) to a temperature of about 70° F. to about 90° F. to form the viscoelastic gel composition which has a density of about 1.28 to about 1.42 grams/liter, more preferably about 1.32 to about 1.42 grams/liter and most preferably about 1.35 grams/liter and has less than about 2 volume % of entrained air bubbles, more preferably less than about 1 volume %, and most preferably less than about 0.5 volume %, wherein the viscoelastic gel composition has a Brookfield viscosity at room temperature using a #4 spindle at 20 rpms of about 1,000 to about 10,000 cps, more preferably about 2,000 to about 8,000 cps, as measured just after it is made and a Brookfield viscosity after one week at room temperature at a #4 spindle at 20 rpm of about 4,000 cps to about 12,000 cps and more preferably about 5,000 cps to about 10,000 cps;

(h) optionally, adding perfume with mixing in line by injection through an injection part (31) into the transfer line 30 carrying the viscoelastic gel composition; and (i) mixing for about 1 to about 10 minutes in an in line static mixer (36) the mixture of the viscoelastic gel composition and the perfume to form a scented viscoelastic gel composition.

The formulation of Example 5 which was prepared using the vibrating feeder (7) and the Delumett homogenous mixer (16) as set forth in step (b)(ii) is in weight %;

| | Weight % |
|---|---|
| Dowfax 3B2 | 0.8 |
| LPKN 158 | 0.158 |
| Stearic Acid[1] | 0.06 |
| NaOH (38%) | 4.5 |
| KTPP (60%) | 33.92 |
| NATPP (3% $H_2O$) | 5.26 |
| Sodium Silicate (47.5%) | 20.83 |
| Carbopol 614 | 1.0 |
| NaOCl (13%) | 8.995 |
| Colorant[2] | 0.003 |

-continued

| | Weight % |
|---|---|
| Perfume[3] | 0.05 |

[1]stearic acid - 50% $C_{18}$ acid + 50% $C_{16}$ acid.
[2]colorant - Cl Direct Yellow 28/Cl/9555 sold by Sandoz Chemical.
[3]perfume - Highlights III perfume sold Bush Bach Aken.

In the production of the above formula the temperature of the deionized water in step (a)(i) was about 180° F.; the concentration of the Dowfax 3B2 in step (a)(i) was 36.78 wt. %, the concentration of the LPKN in step (a)(iii) was 7.356 wt. % and the concentration of stearic acid in step (a)(v) was 2.759 wt. %; stirring in step (a)(vi) was about 5 minutes; the temperature of the deionized water in step (b)(i) was about room temperature, and the Brookfield viscosity of the premix solution in step (g)(ii) after the in line homogenous mixer was about 25,000 cps at room temperature at a #6 spindle at 50 rpms and had less than 1.0 volume % of entrained air bubbles; the concentration of the Carbopol 614 in the premix solution was about 4.8 wt. %; the Brookfield viscosity at room temperature at 50 rpms at #2 spindle was about 5,880 cps; the deionized water which was added to main mixing vessel in step (d) was about room temperature; the temperature of the heated solution (A) in step (e) was about 180° F.; and the temperature of the cooled solution B in step (g) was about 80° F.; mixing of the perfume in step (i) was about 5 minutes.

The formulation was analyzed as follows:

| | |
|---|---|
| Brookfield viscosity at R.T. at #4 spindle at 20 rpms - unaged sample | 4200 cps |
| Brookfield viscosity at R.T. at #4 spindle at 20 rpms 1 week aged sample | 7850 cps |
| Density | 1.38 grams/liter |
| $P_2O_5$ | 12.2 wt. % |
| Appearance | translucent |
| Solids | 41.01 wt. % |
| Available chlorine | 1.15 wt. % |
| Amount of unbound[4] | <0.25 wt. % |
| water solids wt. % | 11.5 |
| pH (1% solution) | |

[4]200 grams of product was placed in a funnel containing filter paper and allowed to filter for 24 hours. The filtrate (water) is collected in a beaker and weighed. The % of unbound water equals weight of the filtrate divided by 2. In both of these samples no water was collected thereby setting forth that there is less than 0.25 wt. % of unbound water in the sample. A sample of Example 1 of U.S. Pat. No. 4,836,946 was tested and it showed a 23 wt. % of unbound water.

[4]200 grams of product was placed in a funnel containing filter paper and allowed to filter for 24 hours. The filtrate (water) is collected in a beaker and weighed. The % of unbound water equals weight of the filtrate divided by 2. In both of these samples no water was collected thereby setting forth that there is less than 0.25 wt. % of unbound water in the sample. A sample of Example 1 of U.S. Pat. No. 4,836,946 was tested and it showed a 23 wt. % of unbound water.

The present invention relates to a process for forming a hydrated cross-linked polyacrylic acid copolymer comprising the steps of:

(a) adding a crosslinked polymer onto a stream of continuously moving deionized water at a concentration of about 0.5 to about 10.0 wt. % of the cross-linked polymer to form a mixture of the wetted cross-linked polymer and the deionized water; and (b) passing said mixture of said wetted cross-linked polymer and said deionized water through an in line homogenous mixer to form an aqueous solution of said hydrated cross-linked polymer having a Brookfield viscosity at room temperature at a #6 spindle at 50 rpms of about 10,000 cps to about 60,000 cps.

The present invention also relates to a process for forming a neutralized crosslinked polyacrylic acid copolymer which comprises the step of mixing an aqueous solution of a cross-linked polyacrylic acid copolymer with an alkali metal silicate in an in line static mixer at a sufficient concentration of said alkali meal silicate to form an aqueous solution of said neutralized cross-linked polyacrylic acid copolymer having a pH of at least about 10 and a Brookfield viscosity at room temperature at a #2 spindle at 50 rpms of about 1,000 cps to about 20,000 cps.

The invention further relates to a mixing unit comprising:

(a) a funnel shape member having an open bottom, an open top and an interior smooth surface;

(b) means for cascading a stream of water on said interior surface of said funnel shaped members; and (c) means for contacting a polymeric material with said stream of water to hydrated said polymer.

What is claimed is:

1. A process for preparing a viscoelastic gel composition having a density of about 1.28 to about 1.42 grams/-liter which comprises the steps of:

(a) forming a predispersion (I) of water and a fatty acid or an alkali salt of a fatty acid, said fatty acid having about 8 to about 24 carbon atoms and at least one ingredient selected from the group consisting of a surfactant and a defoamer;

(b) forming an unneutralized premix solution (II) of a hydrated crosslinked polyacrylic acid in water, said hydrated crosslinked polyacrylic acid being crosslinked with 0.01 to 1.5 percent of a polyunsaturated monomer and said hydrated crosslinked polyacrylic acid having a molecular weight of about 500,000 to 10,000,000, the concentration of said hydrated crosslinked polyacrylic acid in said premix solution being about 2 to 8 wt. percent, said premix solution being used in sufficient quantity to provide 0.1 to 2 wt. percent, of said hydrated cross-linked polyacrylic acid in said composition;

(c) neutralizing the hydrated crosslinked polyacrylic acid with a 40 to 70 weight percent aqueous solution of an alkali metal silicate of form a gel solution (III) containing a neutralized polyacrylic acid thickening agent, said gel solution having a Brookfield viscosity at room temperature at 50 rpms at a #6 spindle of about 1,000 to 20,000 cps and having a pH of at least 10.0, said aqueous solution of said alkali metal silicate being used in sufficient quantity to provide 5.0 to 20.0 wt. percent of said alkali metal silicate in said composition;

(d) adding water (IV) to a mixing vessel;

(e) adding said gel solution (III) to said water (IV) in said mixing vessel;

(f) adding said predispersion (I) of step (a) to said gel solution (III) and water (IV) of step (e) in said mixing vessel;

(g) adding an alkali metal hydroxide to said water (IV) said predispersion (I) of step (a) and said gel solution (III) in said mixing vessel;

(h) adding potassium tripolyphosphate and/or potassium pyrophosphate to said water (IV), said predispersion (I) of step (a), said gel solution (III) and said alkali metal hydroxide in said mixing vessel;

(i) adding sodium tripolyphosphate to said water (IV), said predispersion (I) of step (a), said gel solution (III), said alkali metal hydroxide and said potassium pyrophosphate and/or said potassium tripolyphosphate in said mixing vessel to form said gel mixture;

(j) heating said gel of step (i) to a temperature of about 140° F. to about 200° F.;

(k) adding an alkali metal hypochlorite to the heated gel mixture of step (j) to form said gel composition; and (l) cooling said gel composition of step (k) to a temperature of about 70° F. to about 90° F. and dearating said gel composition to less than about 1.5 volume percent of air, wherein the gel composition comprises approximately by weight:

| | |
|---|---|
| Surfactant | 0.00–5.0% |
| Defoamer | 0.00–1.5% |
| Fatty acid and/or alkali metal salt of fatty acid | 0.02–2.0% |
| Sodium tripolyphosphate | 5.00–35.0% |
| Potassium tripolyphosphate and/or potassium pyrophosphate | 5.00–35.0% |
| Alkali metal hydroxide | 0.50–8.0% |
| Alkali metal silicate | 5.00–20.0% |
| Alkali metal hypochlorite (% available chlorine) | 0.20–4.0% |
| Crosslinked polyacrylic acid | 0.10–2.0% |
| Water | Balance |

2. The process of claim 1 further including the step of adding a colorant to the water (IV) in the mixing vessel prior to the addition of said gel solution (III) in step (e) of claim 1.

3. The process of claim 1, further including adding a perfume to the gel composition subsequent to step (k) of claim 1.

* * * * *

UNITED STATES PATENT AND TRADEMARK OFFICE

CERTIFICATE OF CORRECTION

PATENT NO. : 5,395,547
DATED : March 7, 1995
INVENTOR(S) : Roger Broadwell

It is certified that error appears in the above-identified patent and that said Letters Patent is hereby corrected as shown below:

Drawings:

Delete Fig. 14 and substitute therefor Fig. 14 as shown on the attached sheet.

Signed and Sealed this

Twenty-first Day of November, 1995

Bruce Lehman

*Attest:*

BRUCE LEHMAN

*Attesting Officer*

*Commissioner of Patents and Trademarks*